US011965395B1

(12) United States Patent
von Gynz-Rekowski et al.

(10) Patent No.: US 11,965,395 B1
(45) Date of Patent: Apr. 23, 2024

(54) RUPTURE DISC AND SYSTEM

(71) Applicant: Workover Solutions, Inc., Imperial, PA (US)

(72) Inventors: Gunther H H von Gynz-Rekowski, Montgomery, TX (US); Russell Wayne Koenig, Conroe, TX (US); Kevin J. Rudy, Tomball, TX (US); Brandon Kaderka, Katy, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 18/061,959

(22) Filed: Dec. 5, 2022

(51) Int. Cl.

| | |
|---|---|
| ***E21B 34/10*** | (2006.01) |
| ***E21B 33/10*** | (2006.01) |
| ***E21B 34/06*** | (2006.01) |
| ***F16K 17/16*** | (2006.01) |

(52) U.S. Cl.
CPC ..... *E21B 34/063* (2013.01); *E21B 33/10* (2013.01); *E21B 2200/08* (2020.05)

(58) Field of Classification Search
CPC .... E21B 2200/08; E21B 34/063; E21B 34/10; F16K 17/16; F16K 17/162; F16K 17/1606; Y10T 137/1692; Y10T 137/1737; Y10T 137/1744
See application file for complete search history.

(56) References Cited

U.S. PATENT DOCUMENTS 3,216,611 A * 11/1965 Lechevallier ..... G21C 9/008 220/89.2
4,433,791 A 2/1984 Mulawski
4,512,491 A 4/1985 DeGood et al.
4,905,722 A 3/1990 Rooker et al.
5,022,424 A 6/1991 Reynolds et al.
5,080,124 A * 1/1992 McGregor ..... F16K 17/1606 137/68.27
5,873,206 A * 2/1999 Roberts ..... E04B 1/3211 52/249
6,472,068 B1 10/2002 Glass et al.
7,389,612 B1 * 6/2008 Fischbeck ..... E04B 1/3211 52/655.2

(Continued)

OTHER PUBLICATIONS

Odfjell Well Services, "Rds Rupture Disc Sub," https://www.odfjellwellservices.com/well-intervention-services/wellbore-clean-up/rds-rupture-disc-sub/#:~:text=Share%3A,rupture%20discs%20to%20provide%20redundancy, accessed on Dec. 1, 2022.

(Continued)

*Primary Examiner* — Kenneth L Thompson
(74) *Attorney, Agent, or Firm* — Jones Walker LLP

(57) ABSTRACT

A rupture disc configured to fluidly seal a passageway. The rupture disc includes a base extending from a distal surface to a proximal end, and a central portion extending across the proximal end of the base. The central portion traverses a central axis defined by the base. At least one surface of the central portion, such as an outer surface or inner surface, includes a plurality of facets defined by a plurality of seams. The facets may include one or more flat surfaces and/or one or more conical surfaces. A rupture disc system for fluidly sealing a portion of a wellbore includes the rupture disc disposed within and extending across a housing central bore of a housing, with one or more sealing members engaging the rupture disc and an inner surface of the housing central bore to fluidly seal the housing central bore.

24 Claims, 22 Drawing Sheets

(56) References Cited

U.S. PATENT DOCUMENTS

| | | | | |
|---|---|---|---|---|
| 7,806,189 | B2 | 10/2010 | Frazier | |
| 7,963,340 | B2 * | 6/2011 | Gramstad | E21B 34/063 166/376 |
| 9,739,114 | B2 | 8/2017 | Frazier | |
| 9,821,412 | B2 * | 11/2017 | Walker | B23K 26/362 |
| 10,316,979 | B2 * | 6/2019 | Petrowsky | F16K 17/162 |
| 10,458,201 | B2 | 10/2019 | Frazier | |
| 10,465,812 | B2 * | 11/2019 | Moro-Le Gall | F16K 17/16 |
| 10,871,053 | B2 | 12/2020 | Frazier | |
| 11,098,556 | B2 | 8/2021 | Frazier | |
| 2007/0215207 | A1 | 10/2007 | Mattison | |
| 2008/0202595 | A1 | 8/2008 | Melrose et al. | |
| 2009/0139720 | A1 | 6/2009 | Frazier | |
| 2014/0216756 | A1 | 8/2014 | Getzlaf et al. | |
| 2020/0009666 | A1 | 1/2020 | Krebill et al. | |
| 2021/0381337 | A1 | 12/2021 | Frazier | |

OTHER PUBLICATIONS

Nine Energy Service, "Single MagnumDiskTM," https://nineenergyservice.com/completions-technologies/completion-barrier-valves/single-magnumdisk, accessed on Dec. 1, 2022.

Schlumberger, "KickStart Rupture disc valve" (2019).

PCT International Searching Authority/US, International Search Report and Written Opinion of the International Searching Authority, mailed Feb. 27, 2024, for PCT/US 23/76525, "Rupture Disc and System.".

* cited by examiner

RUPTURE DISC AND SYSTEM

BACKGROUND

In the process of drilling and producing oil and gas wells, certain zones within the wellbore are isolated or sealed from surrounding zones or from the surface of the wellbore. After drilling a wellbore, a casing is typically set along the outer surface of the wellbore. Bridge plugs, packers, and/or other sealing devices are then set within the casing to isolate a single formation zone within the wellbore. For example, the isolated zone may be created between 5,000 and 10,000 feet downstream from the surface. The sealing devices fluidly seal the isolated zone from other zones such that only the isolated zone is in fluid communication with the surface of the wellbore. In other words, the sealing devices prevent fluid communication between all other zones and the surface of the wellbore. The casing in the isolated zone is perforated to allow fluid communication between the subterranean formation and the isolated zone of the wellbore and ultimately the surface of the wellbore.

Rupture discs are sometimes used in sealing devices for fluid isolation of wellbore zones. Conventional rupture discs include smooth arched surfaces, which allow for a greater pressure rating on one side of the rupture disc than the other side. When operations are completed in the isolated zone, the rupture disc may be destroyed to allow fluid communication between other zones and the surface of the wellbore. The destruction of the rupture disc creates fragments of unpredictable size and shape. Often, the disc fragments are large with sharp edges, and therefore create problems, such as blocking openings or presenting difficulty in removing the disc fragments from the wellbore.

BRIEF DESCRIPTION OF THE DRAWING VIEWS

DETAILED DESCRIPTION OF SELECTED EMBODIMENTS

A rupture disc for use in fluidly sealing a passageway is disclosed herein. The rupture disc includes a base, a central portion, and a plurality of facets defined by a plurality of seams on at least one surface of the central portion. In some embodiments, at least one of the plurality of facets is a flat surface having an angular orientation that varies from the angular orientation of the flat surfaces of the adjacent facets. In other embodiments, at least one of the plurality of facets is a conical surface. In still other embodiments, the plurality of facets includes one or more flat surfaces and one or more conical surfaces. The plurality of seams provide weaker points than surrounding surfaces. The rupture disc's central portion is configured to fracture along the plurality of seams in response to a rupture event. Upon this rupture event, the plurality of seams are configured to provide a greater number of smaller disc fragments, which are easier to clear from the wellbore. The rupture event may be a physical or mechanical force applied to the rupture disc. Alternatively, the rupture event may include application of a pressure that exceeds a predefined pressure rating of a surface of the rupture disc's central portion. In still other embodiments, the rupture event may include contacting the fracture disc with a fluid capable of dissolving or otherwise breaking down the material of the fracture disc.

A rupture disc system includes the rupture disc disposed within a housing central bore of a housing to fluidly seal the housing central bore. The rupture disc system may also include one or more sealing members engaging the rupture disc and an inner surface of the housing central bore to fluidly seal the housing central bore. The rupture disc system may be placed within a wellbore to provide a temporary fluid seal inside the rupture disc system.

FIGS. 1-28 illustrate multiple embodiments of the rupture disc and the rupture disc system disclosed herein, with many other embodiments within the scope of the claims being readily apparent to skilled artisans after reviewing this disclosure.

Figure 1:
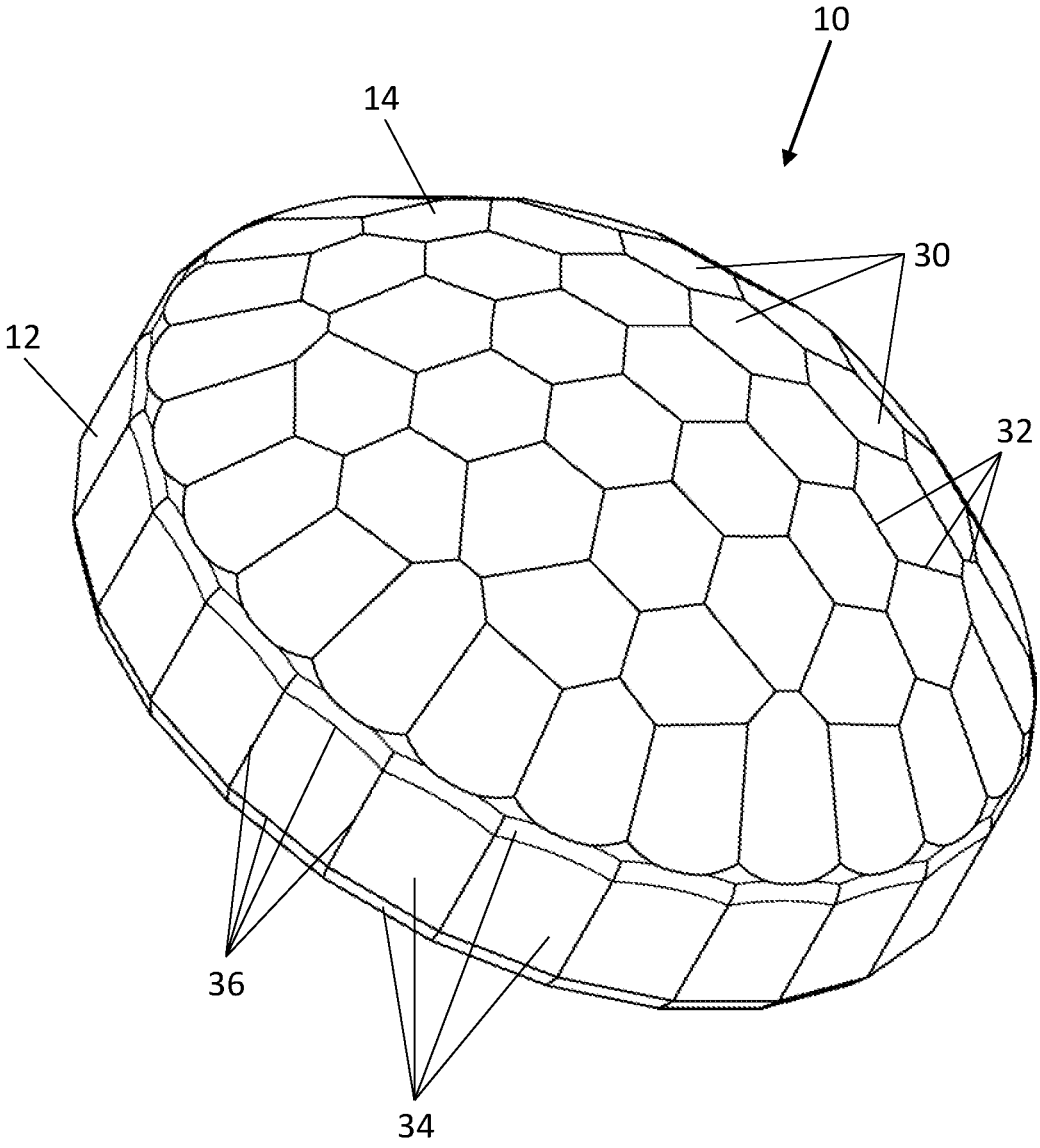
FIG. 1 is a perspective view of a rupture disc.
Figure 2:
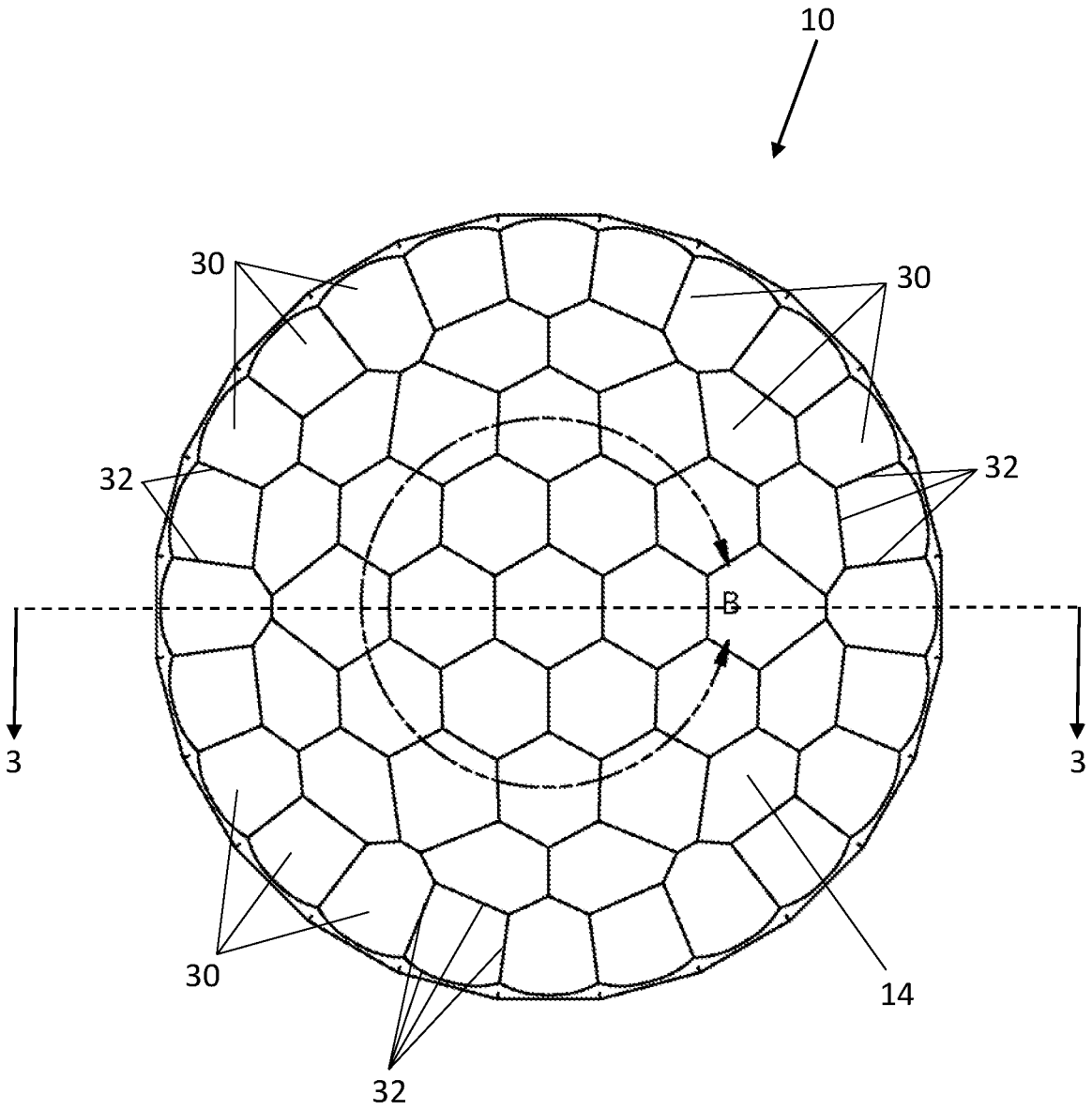
FIG. 2 is a top view of the rupture disc.
Figure 3:
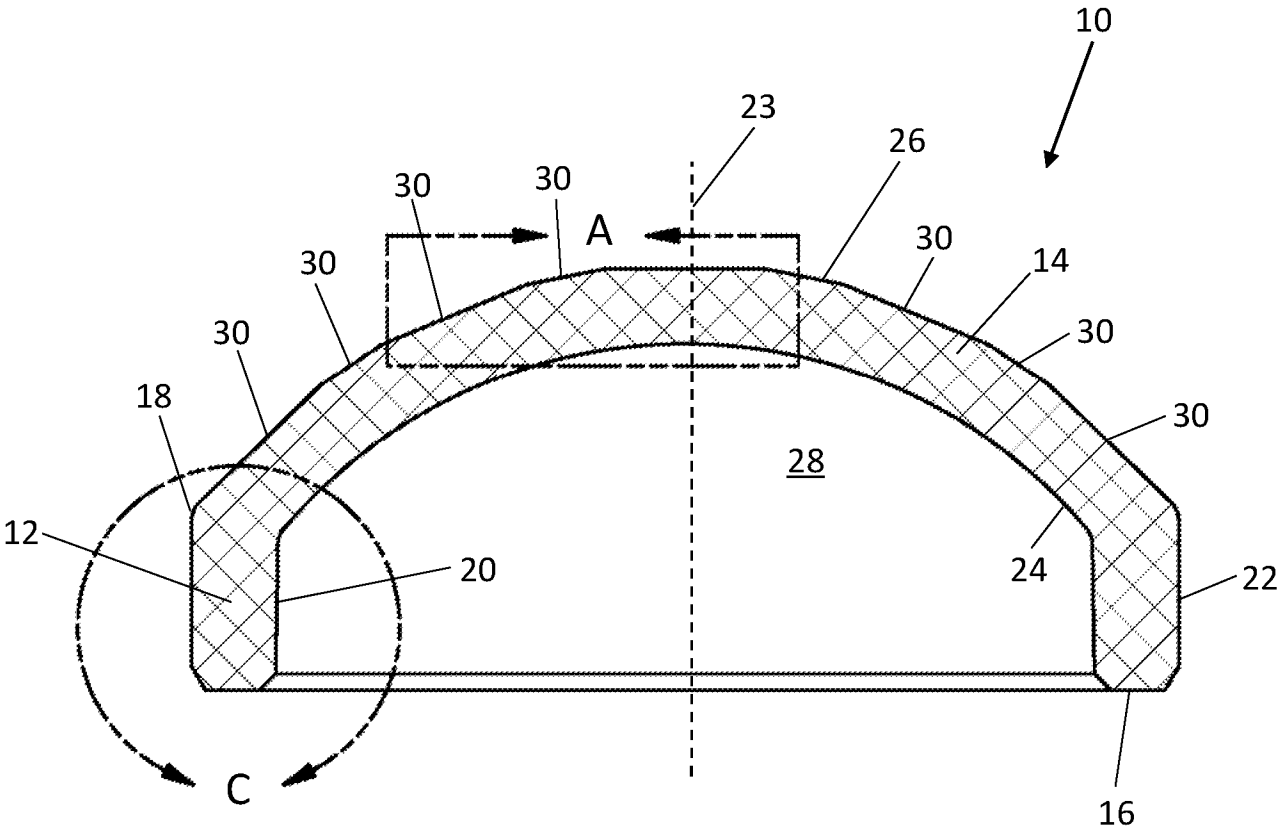
FIG. 3 is a sectional view of the rupture disc taken along line 3-3 in FIG. 2.

With reference to FIGS. 1-3, rupture disc 10 includes base 12 and central portion 14. Base 12 has a non-cylindrical shape with non-parallel outer and inner surfaces. Base 12 extends from distal surface 16 to proximal end 18. Base 12 includes inner surface 20 and outer surface 22, which are each generally concentrically positioned about a central axis 23. In this way, central axis 23 is defined by base 12. Base 12 may have a diameter in the range of 1 inch to 4 inches, or any subrange therein. Preferably, base 12 may have a diameter in the range of 2 inches to 3 inches, or any subrange therein, depending on the tool size of the rupture disc system.

Central portion 14 may extend across proximal end 18 such that central portion 14 traverses central axis 23. Central portion 14 includes inner surface 24 and outer surface 26. Inner surface 24 of central portion 14 and inner surface 20 of base 12 define inner space 28. Outer surface 26 of central portion 14 may have a convex shape, while inner surface 24 of central portion 14 may have a concave shape. As used herein, "traverse" or "traverses" means extending in an orientation that intersects another object or intersects a longitudinal axis of an object. As used herein, "convex shape" means an outer surface having at least one section that extends beyond the outermost sections of the outer surface or beyond proximal end 18 of base 12. As used herein, "concave shape" means an inner surface with at least one section that extends beyond the outermost sections of the inner surface such that the inner surface has a concave shape in relation to inner space 28. "Beyond" in this context means a greater distance from distal surface 16 of base 12 in a direction parallel to central axis 23.

As shown in FIGS. 2-5, this embodiment of rupture disc 10 includes outer surface 26 of central portion 14 having a plurality of facets 30 defined by a plurality of seams 32. In this embodiment, each facet 30 is a flat surface having an angular orientation. In this way, outer surface 26 includes an arrangement of flat surfaces. The angular orientation of each facet 30 may vary from the angular orientation of adjacent facets 30. For example, central portion 14 may include facets 30A, 30B, 30C, 30D, and 30E defined by a plurality of seams 32. Facet 30B may be defined by seams 32A-32F. Facet 30C may be defined by seams 32F-32K. Facet 30D may be defined by seams 32K-32P. Each of the plurality of seams 32 separate two adjacent facets 30. For example, seam 32A separates facet 30A and facet 30B, seam 32F separates facet 30B and facet 30C, seam 32K separates facet 30C and facet 30D, and seam 32P separates facet 30D and facet 30E. Similarly, seam 32C separates facet 30B and facet 30I, seam 32G separates facet 30C and facet 30I, seam 32H separates facet 30C and facet 30H, seam 32L separates facet 30D and facet 30H, seam 32E separates facet 30B and facet 30G, and seam 32I separates facet 30C and facet 30G. In the embodiment illustrated, plurality of seams 32 form facets 30 including hexagonal facets and pentagonal facets. In certain embodiments, plurality of seams 32 may form facets in the shape of a truncated icosahedron. Some seams 32 are formed by straight lines, while other seams 32 can be formed by non-straight lines. In certain embodiments, plurality of seams 32 may form a pattern that includes a portion of a truncated icosahedron. As used herein, "facet" means a flat surface having a constant angular orientation, or a conical surface. As used herein, "angular orientation" means a set of angles including an angle formed between the relevant surface and central axis 23, an angle formed between the relevant surface and an x-axis, and an angle formed between the relevant surface and a y-axis. As used herein, "flat" means a substantially planar surface, which may or may not include insignificant deviations from the plane (e.g., a very small bump or similar irregularity). As used herein, "conical surface" means a segment of a surface formed by moving one end of a straight line in a curve or in a circle while the other end of the straight line remains stationary.

Figure 4:
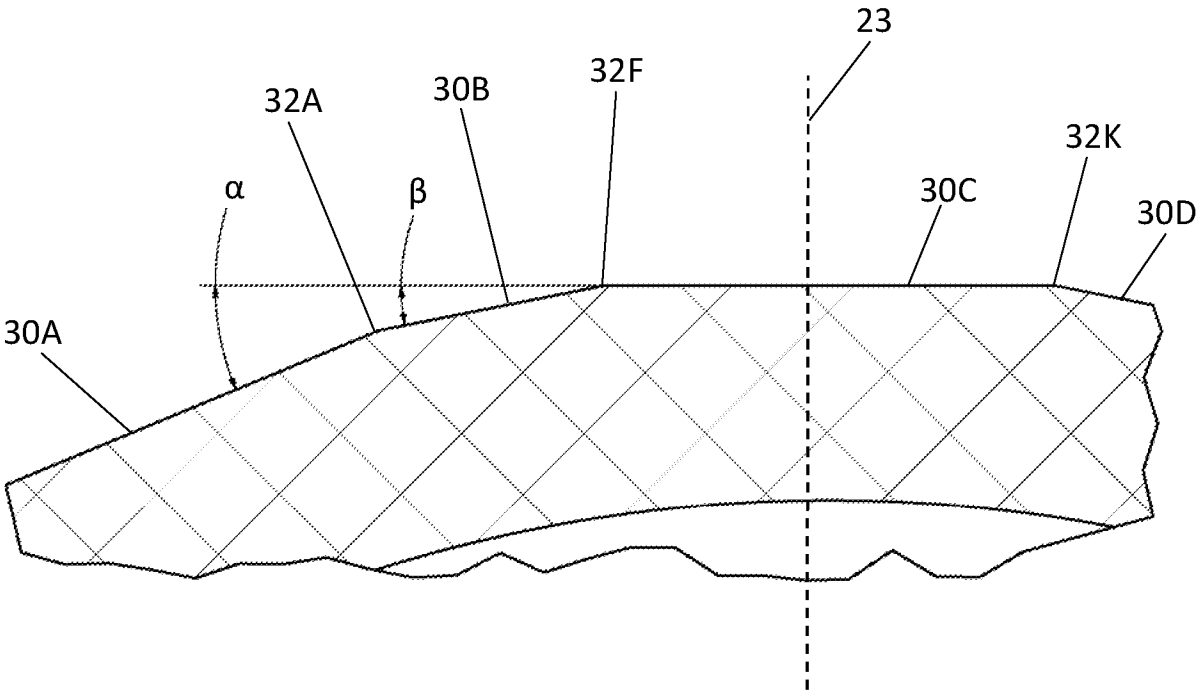
FIG. 4 is a partial sectional view of the rupture disc taken at section A in FIG. 3.
Figure 5:
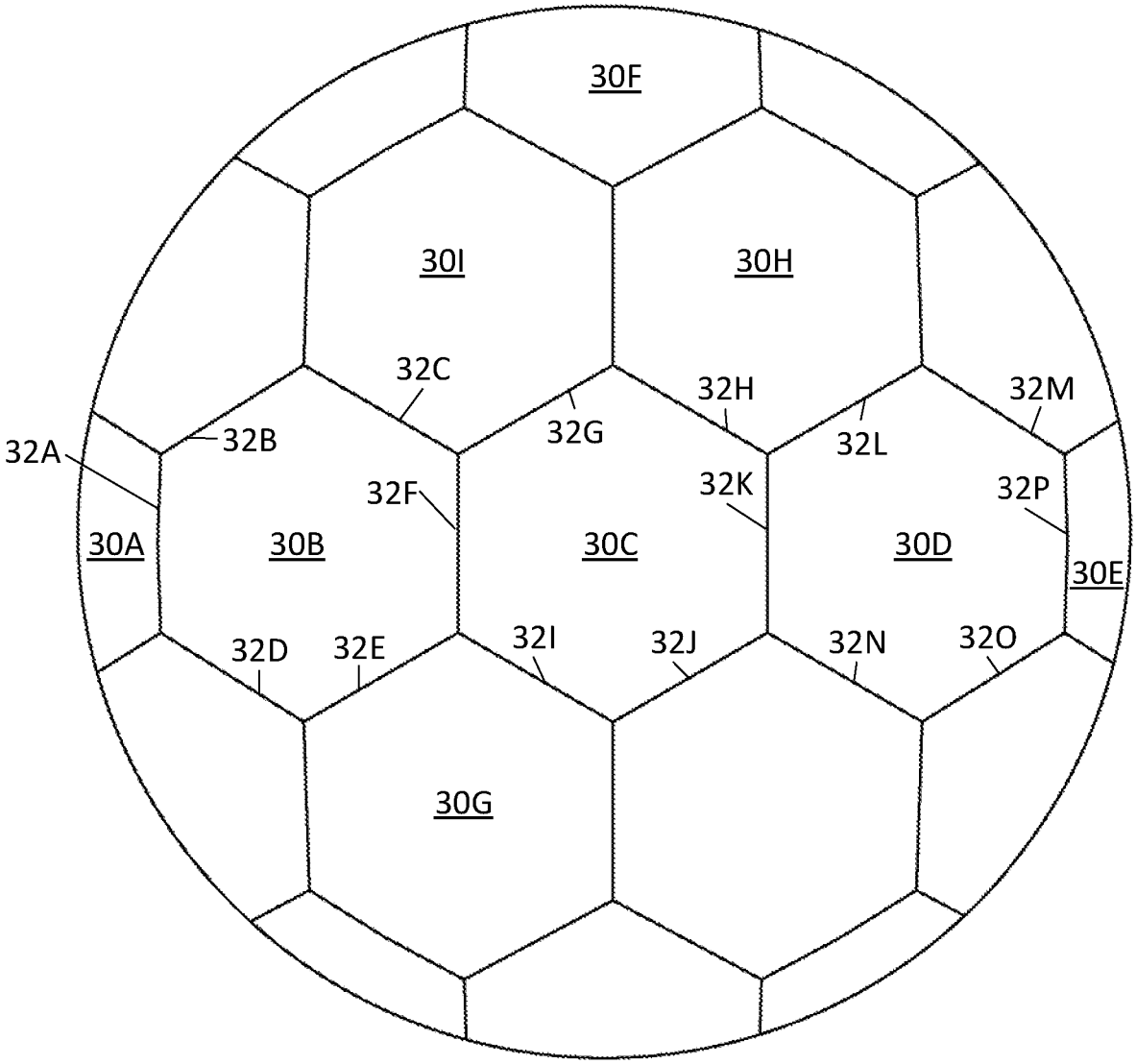
FIG. 5 is a partial top view of the rupture disc taken at section B in FIG. 2.

With reference to FIG. 4, the angular orientation of outer surface 26 of central portion 14 changes at each of the plurality of seams 32. For example, facet 30C may have an angular orientation that is generally perpendicular to central axis 23. The angular orientation of facet 30B may vary from the angular orientation of facet 30C by angle $\beta$, which is formed at seam 32F. Similarly, the angular orientation of facet 30A may vary from the angular orientation of facet 30C by angle $\alpha$, which is formed at seams 32A and 32F. As shown by the variance between angle $\alpha$ and angle $\beta$, the angular orientation of facet 30A may vary from the angular orientation of facet 30B.

Central portion 14 may be configured to rupture or break upon a rupture event. The variation in the angular orientation of outer surface 26 along the plurality of seams 32 forms weak points along the plurality of seams 32. Because of these weak points, rupture disc 10 is configured to fracture along the plurality of seams 32 in response to the rupture event.

In one embodiment, the rupture event may be application of a first predefined pressure on outer surface 26 of central portion 14 or application of second predefined pressure on inner surface 24 of central portion 14. In other words, central portion 14 is configured to have a first predefined pressure rating for the outer surface 26 and a second predefined pressure rating for the inner surface 24. The convex shape of outer surface 26 of central portion 14 enables central portion 14 to withstand a higher hydraulic pressure applied to outer surface 26. In other words, the convex shape of outer surface 26 and the concave shape of inner surface 24 enables the first predefined pressure rating to be higher than the second predefined pressure rating. For example, the first predefined pressure rating for outer surface 26 may be in the range of 2,000 psi to 10,000 psi, while the second predefined pressure rating for inner surface 24 may be in the range of 500 psi to 2,000 psi. In some embodiments, central portion 14 is configured to break or fracture upon application of these predefined pressure ratings. In other embodiments, central portion 14 is configured to break or fracture upon application of a pressure that exceeds these predefined pressure ratings. The presence of the plurality of seams 32 may cause rupture disc 10 to fracture into a larger number of fragments, with the fragments having generally smaller sizes.

In other embodiments, the rupture event may be a physical or mechanical force applied to central portion 14 of rupture disc 10, which may cause central portion 14 to fracture or break along plurality of seams 32. In still other embodiments, the rupture event may be contacting rupture disc 10 with a fluid capable of dissolving, solubilizing, suspending, or otherwise breaking down the material of rupture disc 10. As used herein, "rupture event" means an occurrence that causes a change in the rupture disc, including the rupture disc's central portion, such that the rupture disc is no longer capable of hydraulically sealing a passageway. "Passageway" in this context is any elongated space configured for fluid flow and configured to contain the rupture disc for providing a fluid seal therein.

In certain embodiments, such as the embodiment illustrated in FIG. 1, outer surface 22 of base 12 may also include a plurality of facets 34 defined by a plurality of seams 36. The angular orientation of outer surface 22 of base 12 may vary at each of the plurality of seams 36. The variation in the angular orientation of outer surface 22 along the plurality of seams 36 forms weak points along the plurality of seams 36. Because of these weak points, rupture disc 10 is configured to fracture along the plurality of seams 36 in response to a rupture event. As described above, the rupture event may include application of a pressure exceeding a predefined pressure rating of outer surface 26 or inner surface 24 of central portion 14, physical or mechanical fracturing of rupture disc 10, or contacting rupture disc 10 with a fluid capable of dissolving or otherwise breaking down the material of rupture disc 10. The presence of the plurality of seams 36 may cause base 12 of rupture disc 10 to fracture into a larger number of fragments, with the fragments having generally smaller sizes. In other embodiments, such as the embodiment shown in FIGS. 9-12, outer surface 22 of base 12 may include a continuous circumferential surface without any seams.

Figure 6:
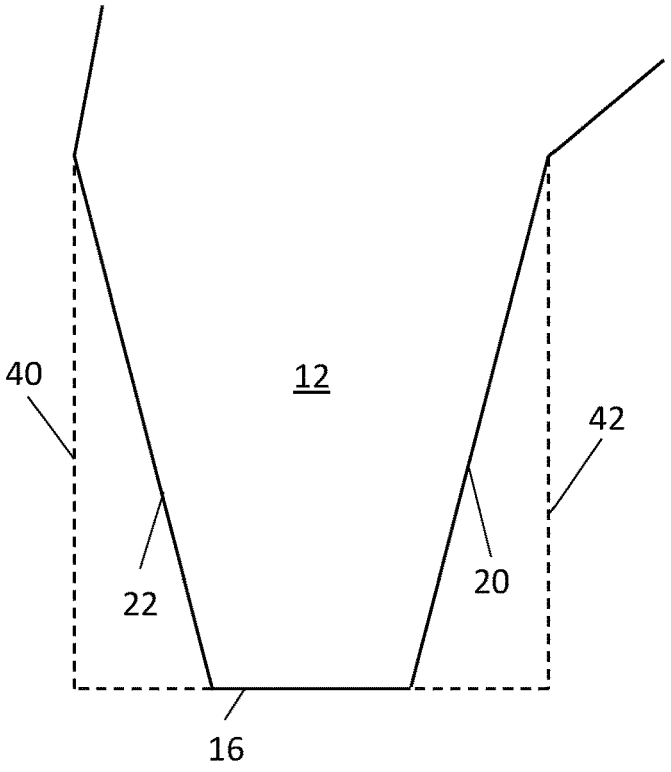
FIG. 6 is a sectional view of an alternate embodiment of section C of the rupture disc in FIG. 3.
Figure 7:
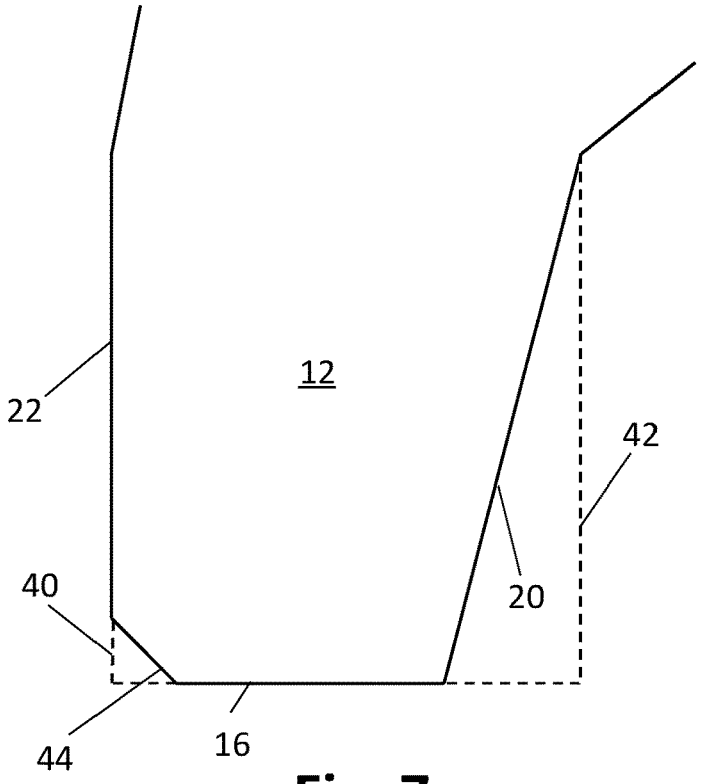
FIG. 7 is a sectional view of a second alternate embodiment of section C of the rupture disc in FIG. 3.
Figure 8:
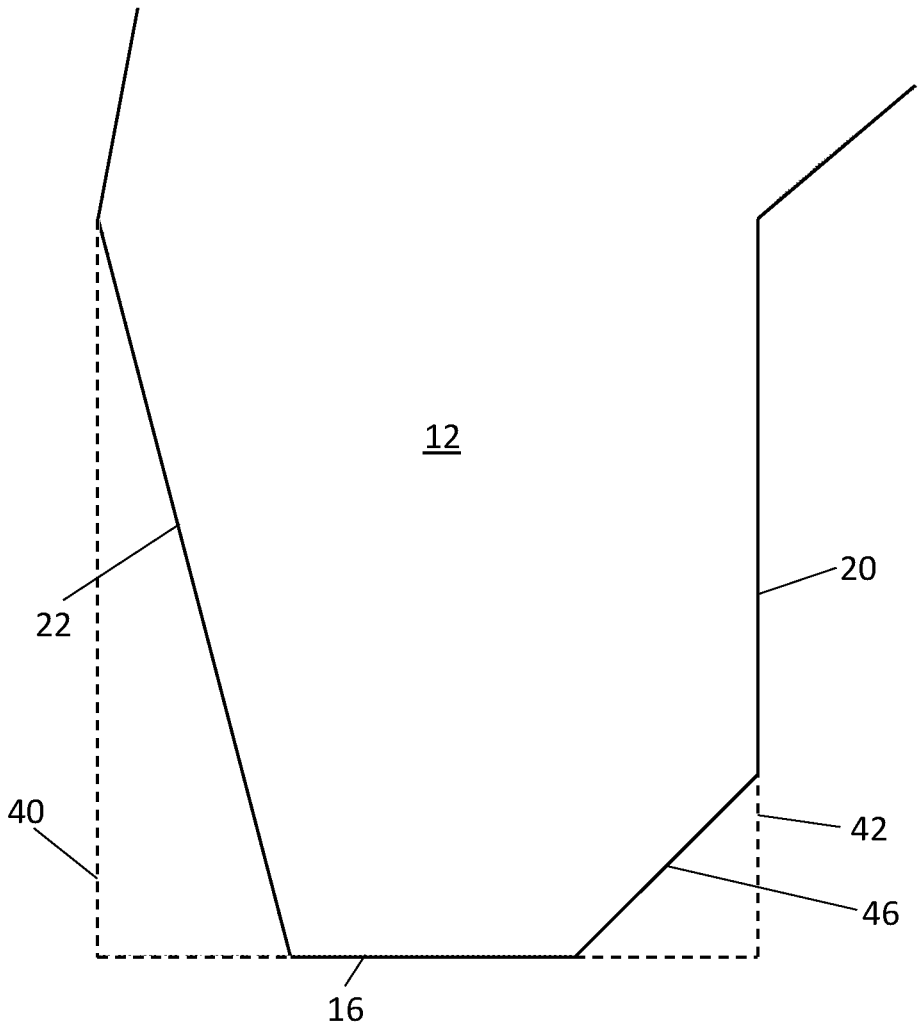
FIG. 8 is a sectional view of a third alternate embodiment of section C of the rupture disc in FIG. 3.
Figure 9:
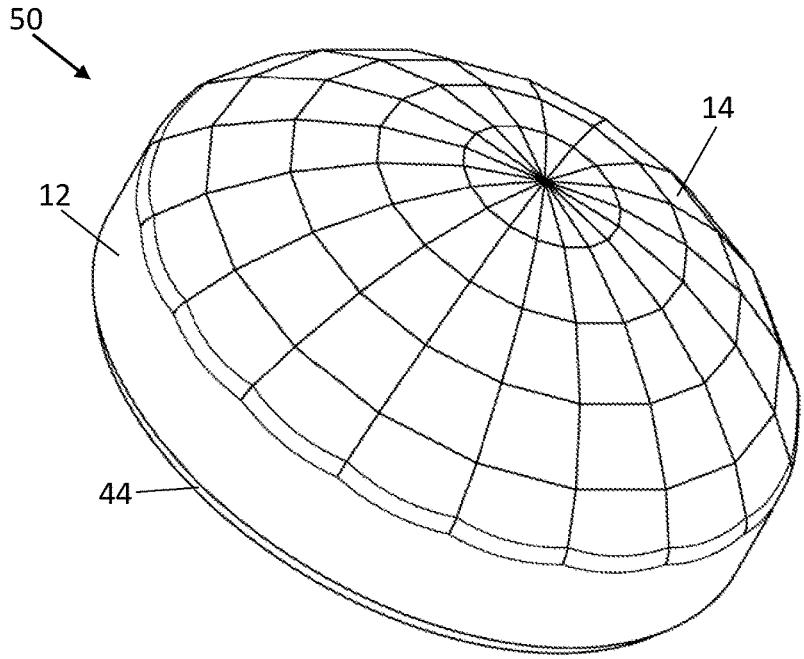
FIG. 9 is a top perspective view of an alternate embodiment of the rupture disc.
Figure 10:
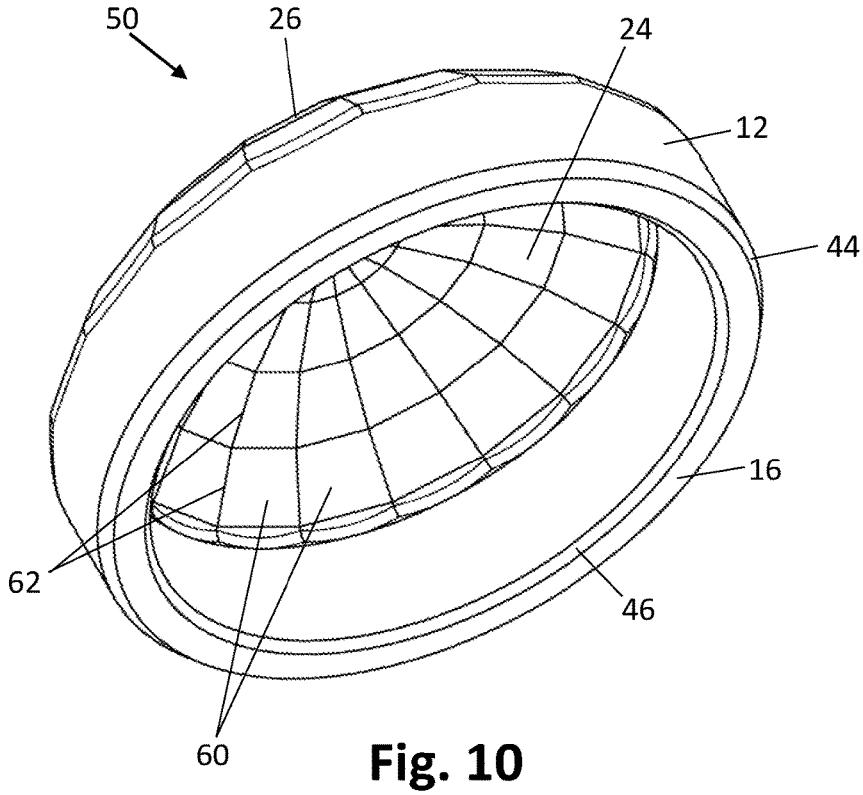
FIG. 10 is a bottom perspective view of the rupture disc shown in FIG. 9.
Figure 11:
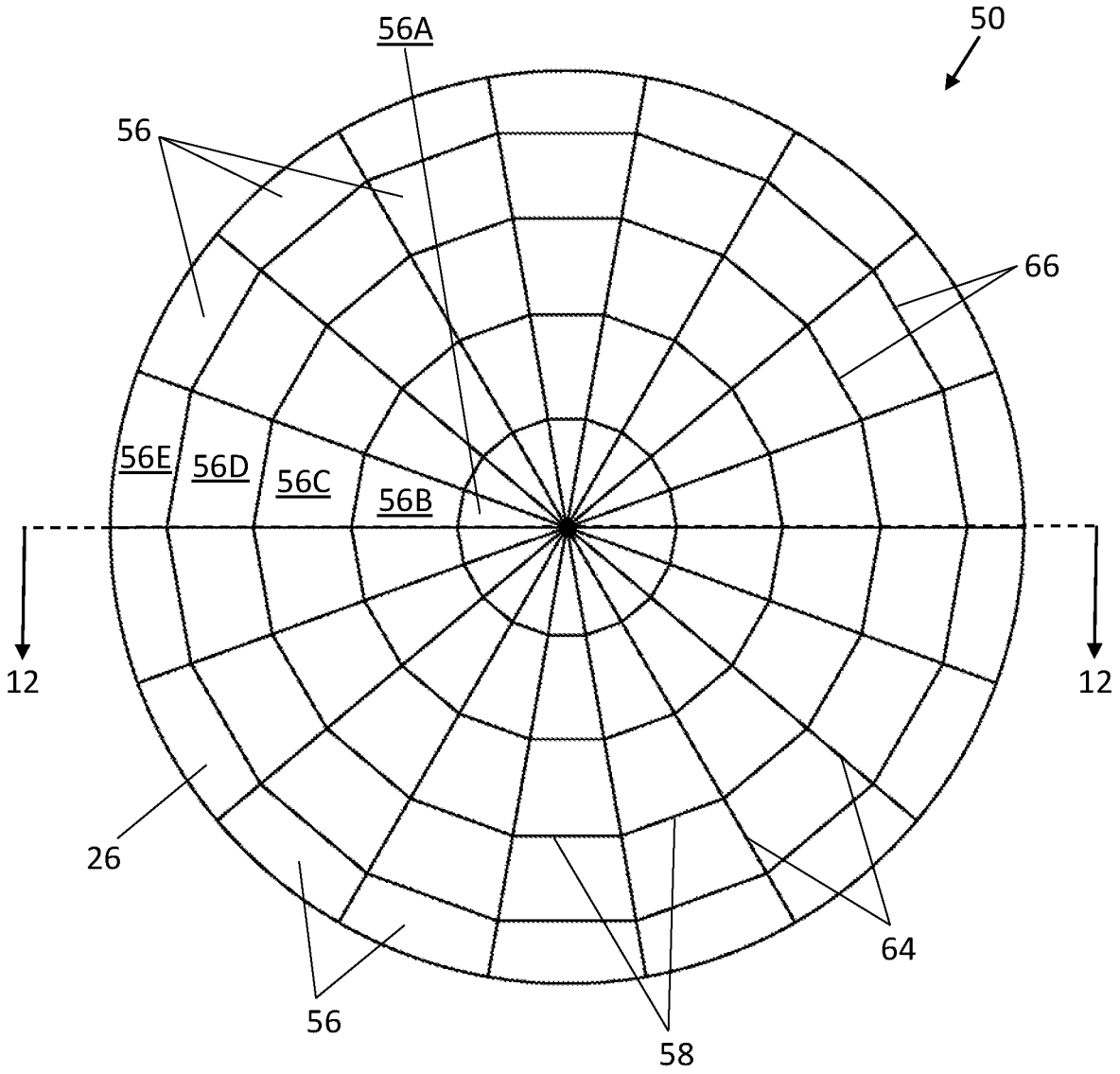
FIG. 11 is a top view of the rupture disc shown in FIG. 9.
Figure 12:
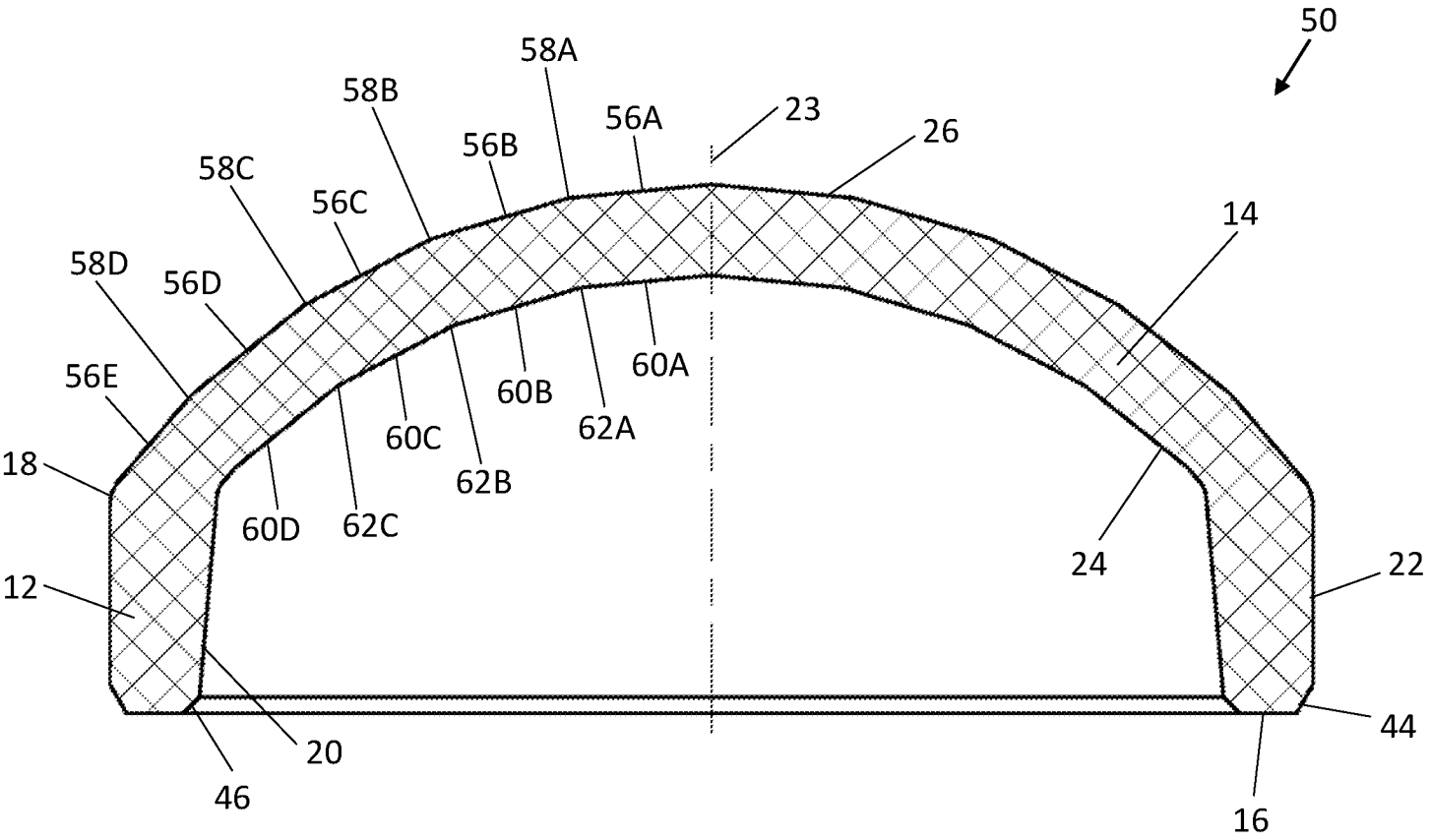
FIG. 12 is a sectional view of the rupture disc taken along line 12-12 in FIG. 11.

Referring now to FIGS. 6-8, base 12 includes one or more tapered surfaces along inner surface 20 or outer surface 22. Inner surface 20 and/or outer surface 22 may be inclined at an angle of 1 degree to 10 degrees relative to central axis 23 of base 12. For example, FIG. 6 illustrates an embodiment in which outer surface 22 of base 12 is tapered relative to line 40, which is parallel to central axis 23. Inner surface 20 of base 12 may also be tapered relative to line 42, which is also parallel to central axis 23. As used herein, "tapered" means that a referenced surface is not parallel to a central axis.

In the embodiment illustrated in FIG. 7, base 12 may include inner surface 20 that is tapered relative to line 42 and central axis 23. In this embodiment, outer surface 22 may include tapered distal portion 44. Tapered distal portion 44 may be tapered relative to line 40 and central axis 23.

As shown in FIG. 8, other embodiments of base 12 may include outer surface 22 that is tapered and inner surface 20 that is tapered and also includes tapered distal portion 46. Tapered distal portion 46 may be tapered relative to line 42 and central axis 23.

Rupture disc 10 may be formed of a rigid and stiff material. In some embodiments, rupture disc 10 is formed of a frangible material. For example, rupture disc 10 may be formed of a ceramic material, such as silicon nitride, fiber reinforced ceramics, zirconia ceramics, alumina ceramics, beryllium oxide ceramics, glass, or any other material capable of withstanding pressures in the range of 1,000 psi to 10,000 psi. In certain embodiments, rupture disc 10 may be formed of a soluble or dissolvable material that is capable of being dissolved or otherwise broken down by at least one fluid.

FIGS. 9-12 illustrate an alternate embodiment of the rupture disc. Rupture disc 50 includes base 12 and central portion 14. Base 12 extends from distal surface 16 to proximal end 18. Optionally, outer surface 22 of base 12 may include tapered distal portion 44, which is tapered relative to central axis 23. Inner surface 20 of base 12 may be tapered relative to central axis 23 and may include tapered distal portion 46, which is tapered by a greater degree relative to central axis 23. In alternate embodiments, rupture disc 50 may include a tapered outer surface, a tapered inner surface, or no tapered surfaces on base 12. In certain embodiments, outer surface 22 and inner surface 20 of base 12 may each include a continuous circumferential surface without seams. Base 12 defines central axis 23 of rupture disc 50. Except as otherwise described, rupture disc 50 includes the same features and specifications as rupture disc 10.

Central portion 14 of rupture disc 50 includes inner surface 24 and outer surface 26, each including a plurality of facets defined by a plurality of seams. Specifically, outer surface 26 may include plurality of facets 56 defined by plurality of seams 58. Inner surface 24 may include plurality of facets 60 defined by plurality of seams 62. Facets 60 and seams 62 of inner surface 24 may generally align with facets 56 and seams 58 of outer surface 26. Facets 56 and facets 60 may form any pattern, such as a web pattern or a portion of a truncated icosahedron. For example, the web pattern of seams 58 in the illustrated embodiment may be formed by a plurality of radial lines 64 and a plurality of concentric line segments 66 intersecting radial lines 64.

The angular orientation of each of facets 56 relative to central axis 23 may vary from adjacent facets 56. For example, outer surface 26 of central portion 14 of rupture disc 50 may include facets 56A, 56B, 56C, 56D, and 56E each with a different angular orientation relative to central axis 23. Seam 58A may separate facets 56A and 56B, seam 58B may separate facets 56B and 56C, seam 58C may separate facets 56C and 56D, and seam 58D may separate facets 56D and 56E. Similarly, the angular orientation of each of facets 60 relative to central axis 23 may vary from adjacent facets 60. For example, inner surface 24 of central portion 14 of rupture disc 50 may include facets 60A, 60B, 60C, and 60D, each with a different angular orientation relative to central axis 23. Seam 62A may separate facets 60A and 60B, seam 62B may separate facets 60B and 60C, and seam 62C may separate facets 60C and 60D.

The variation in the angular orientation of the inner and outer surfaces 24 and 26 along the plurality of seams 62 and 58, respectively, may form weak points along the plurality of seams 62 and 58. Because of these weak points, rupture disc 50 is configured to fracture along the plurality of seams 62 and 58 in response to a rupture event. As described above, the rupture event may include application of a pressure exceeding a predefined pressure rating of outer surface 26 or inner surface 24 of central portion 14, physical or mechanical fracturing of rupture disc 10, or contacting rupture disc 10 with a fluid capable of dissolving or otherwise breaking down the material of rupture disc 10. The presence of the plurality of seams 62 and 58 may cause rupture disc 50 to fracture into a larger number of fragments, with the fragments having generally smaller sizes.

Figure 13:
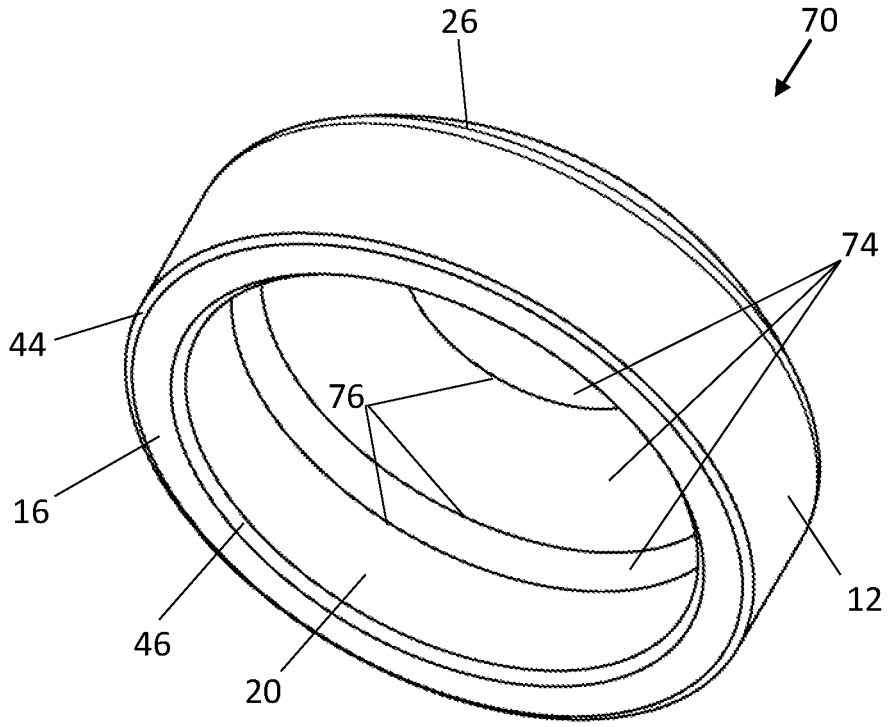
FIG. 13 is a bottom perspective view of a second alternate embodiment of the rupture disc.
Figure 14:
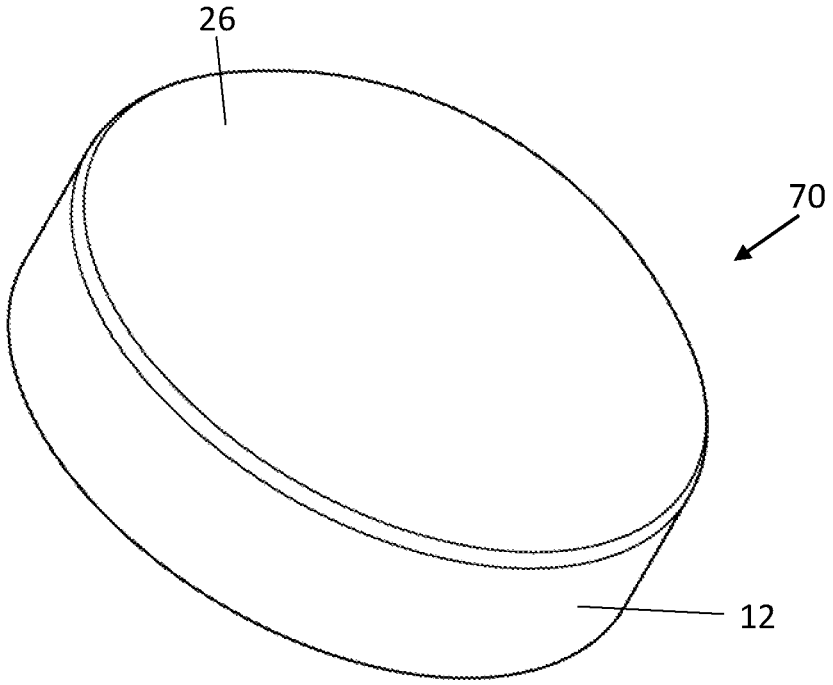
FIG. 14 is a top perspective view of the rupture disc shown in FIG. 13.
Figure 15:
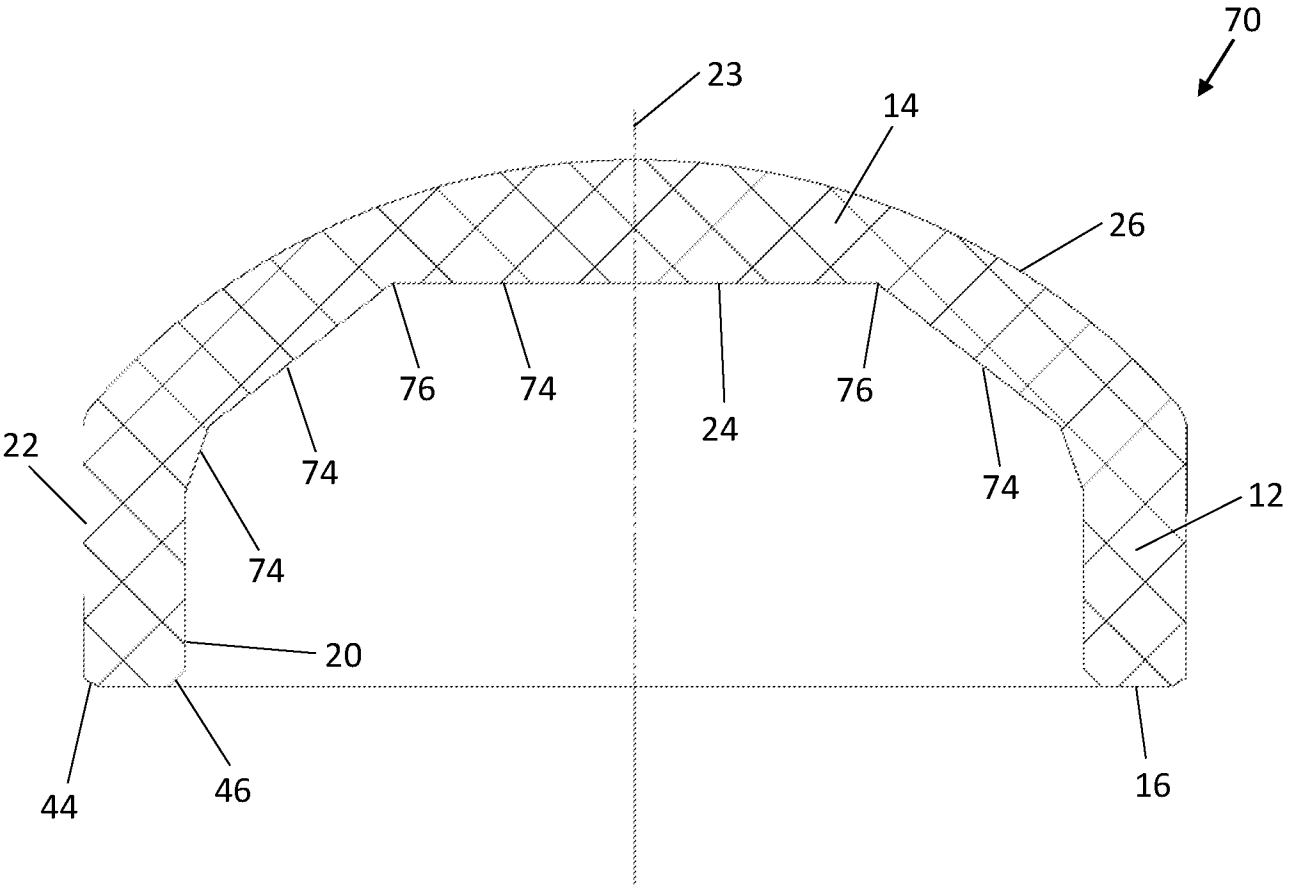
FIG. 15 is a central sectional view of the rupture disc shown in FIG. 13.

FIGS. 13-15 illustrate another alternate embodiment of the rupture disc. Rupture disc 70 includes base 12 and central portion 14. Base 12 of rupture disc 70 may include outer surface 22 having tapered distal portion 44 and inner surface 20 having tapered distal portion 46. Rupture disc 70 may include central portion 14 having outer surface 26 with a continuous surface as shown in FIG. 14, along with inner surface 24 with a plurality of facets 74 defined by a plurality of seams 76. In this embodiment, the seams 76 form concentric circles about central axis 23. At least one of the facets 74 is a conical surface, and at least one of the facets 74 is a flat surface. In certain embodiments, facets 74 include compound conical surfaces. For example, the facets 74 may include compound conical surfaces and one central flat surface. As used herein, "compound conical surfaces" mean adjacent and concentric conical surfaces, with a slope of each conical surface in relation to a central axis varying from the slope of adjacent conical surfaces in relation to the central axis.

The plurality of seams 76 may define weak points. Because of these weak points, rupture disc 70 may be configured to fracture along the plurality of seams 76 in response to a rupture event. As described above, the rupture event may include application of a pressure exceeding a predefined pressure rating of outer surface 26 or inner surface 24 of central portion 14, physical or mechanical fracturing of rupture disc 10, or contacting rupture disc 10 with a fluid capable of dissolving or otherwise breaking down the material of rupture disc 10. The presence of the plurality of seams 76 may cause rupture disc 70 to fracture into a larger number of fragments, with the fragments having generally smaller sizes. Except as otherwise described, rupture disc 70 includes the same features and specifications as rupture disc 10.

Figure 16:
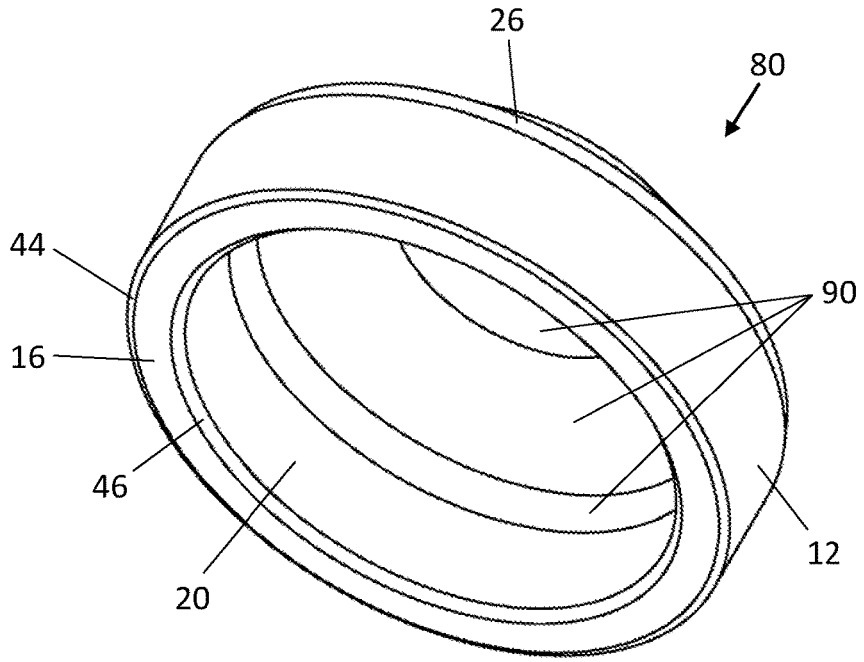
FIG. 16 is a bottom perspective view of a third alternate embodiment of the rupture disc.
Figure 17:
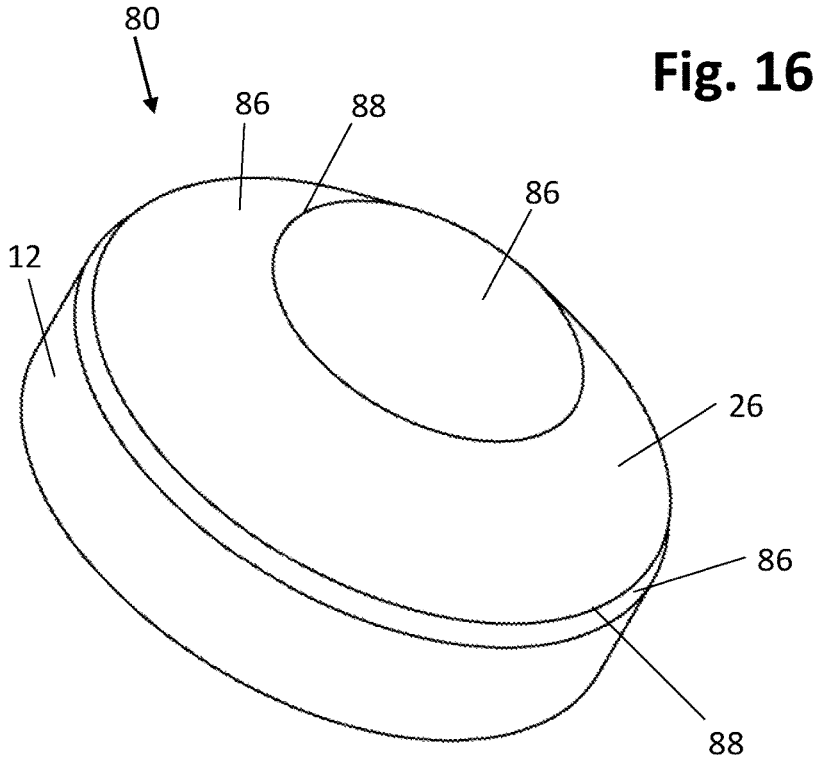
FIG. 17 is a top perspective view of the rupture disc shown in FIG. 16.
Figure 18:
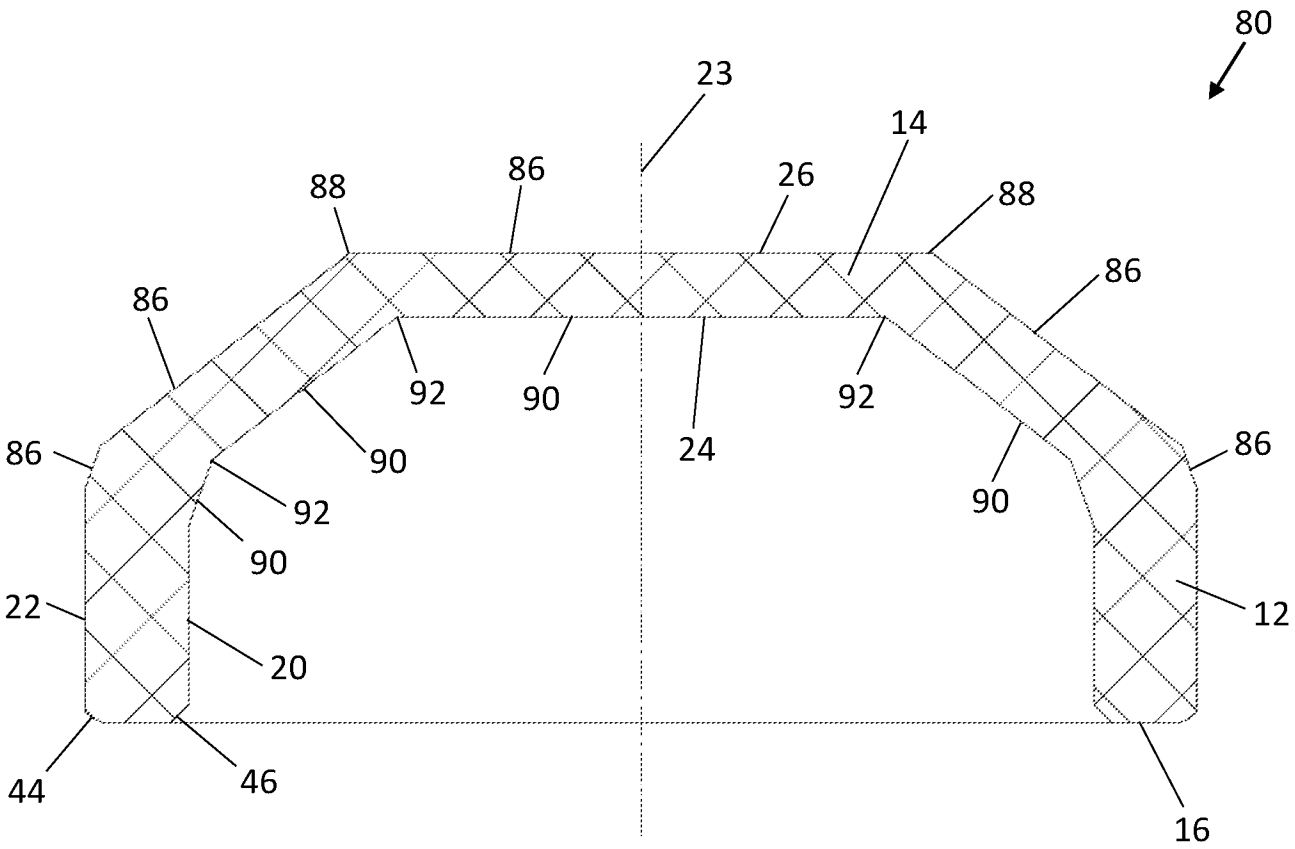
FIG. 18 is a central sectional view of the rupture disc shown in FIG. 16.

FIGS. 16-18 illustrate another alternate embodiment of the rupture disc. Rupture disc 80 includes base 12 and central portion 14. Base 12 of rupture disc 80 may include outer surface 22 having tapered distal portion 44 and inner surface 20 having tapered distal portion 46. Rupture disc 80 may include central portion 14 having outer surface 26 with a plurality of facets 86 defined by a plurality of seams 88, along with inner surface 24 with a plurality of facets 90 defined by a plurality of seams 92. In this embodiment, seams 88 and seams 92 form concentric circles about central axis 23. Also in this embodiment, at least one of the facets 86 is a conical surface, and at least one of the facets 90 is a conical surface. In some embodiments, facets 86 may include at least one conical surface and at least one flat surface, and facets 90 may include at least one conical surface and at least one flat surface. In certain embodiments, facets 86 and 90 each include compound conical surfaces. For example, the facets 86 and 90 may each include compound conical surfaces and one central flat surface.

The plurality of seams 92 and 88 define weak points. Because of these weak points, rupture disc 80 is configured to fracture along the plurality of seams 92 and 88 in response to a rupture event. As described above, the rupture event may include application of a pressure exceeding a predefined pressure rating of outer surface 26 or inner surface 24 of central portion 14, physical or mechanical fracturing of rupture disc 10, or contacting rupture disc 10 with a fluid capable of dissolving or otherwise breaking down the material of rupture disc 10. The presence of the plurality of seams 92 and 88 may cause rupture disc 80 to fracture into a larger number of fragments, with the fragments having generally smaller sizes. Except as otherwise described, rupture disc 80 includes the same features and specifications as rupture disc 10.

Figure 19:
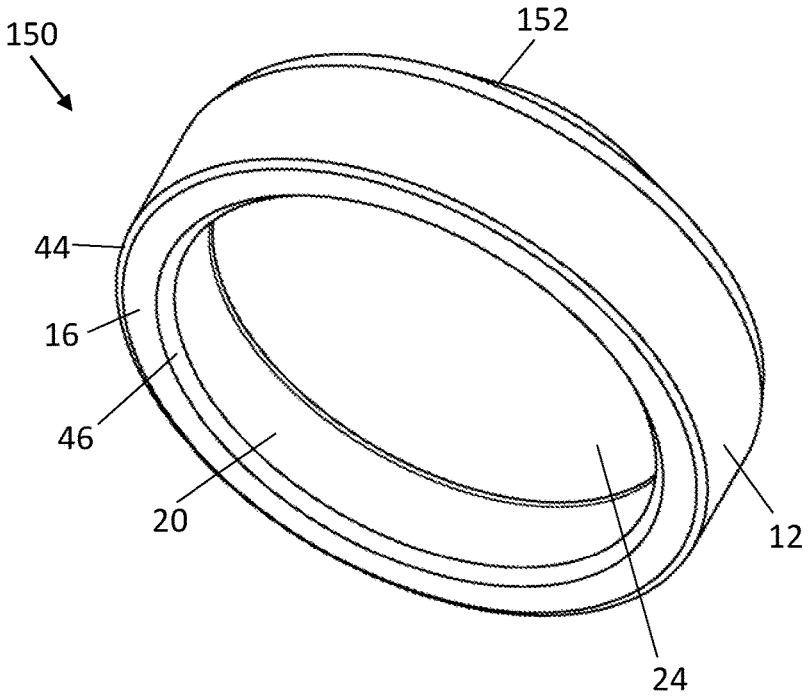
FIG. 19 is a bottom perspective view of a fourth alternate embodiment of the rupture disc.
Figure 20:
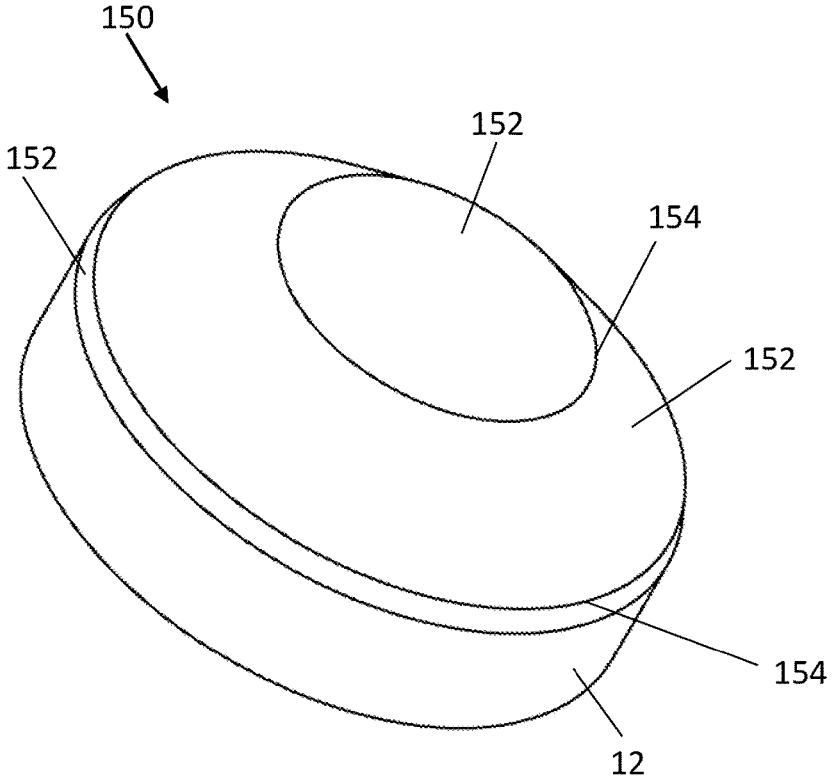
FIG. 20 is a top perspective view of the rupture disc shown in FIG. 19.
Figure 21:
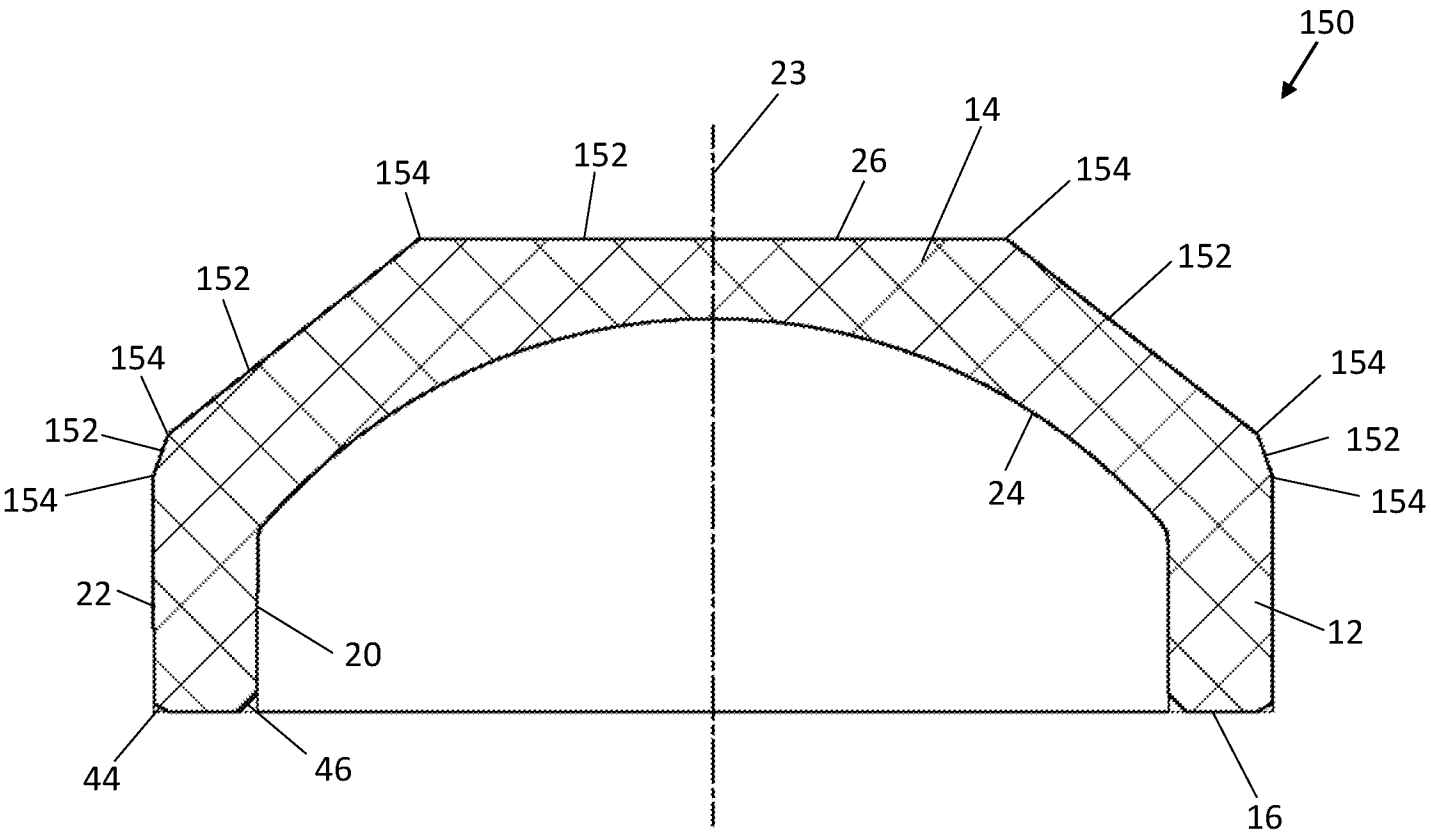
FIG. 21 is a central sectional view of the rupture disc shown in FIG. 19.

FIGS. 19-21 illustrate yet another alternate embodiment of the rupture disc. Rupture disc 150 includes base 12 and central portion 14. Base 12 of rupture disc 150 may include outer surface 22 having tapered distal portion 44 and inner surface 20 having tapered distal portion 46. Outer surface 22 and/or inner surface 20 may be tapered relative to central axis 23. Central portion 14 of rupture disc 150 may include outer surface 26 having a plurality of facets 152 defined by a plurality of seams 154, along with inner surface 24 having a continuous surface as shown in FIG. 21. In this embodiment, the seams 154 form concentric circles around central axis 23, and at least one of the facets 152 is a conical surface. In some embodiments, facets 152 may include at least one conical surface and at least one flat surface. In certain embodiments, facets 152 may include compound conical surfaces. For example, the facets 152 may include compound conical surfaces and one central flat surface.

Figure 22:
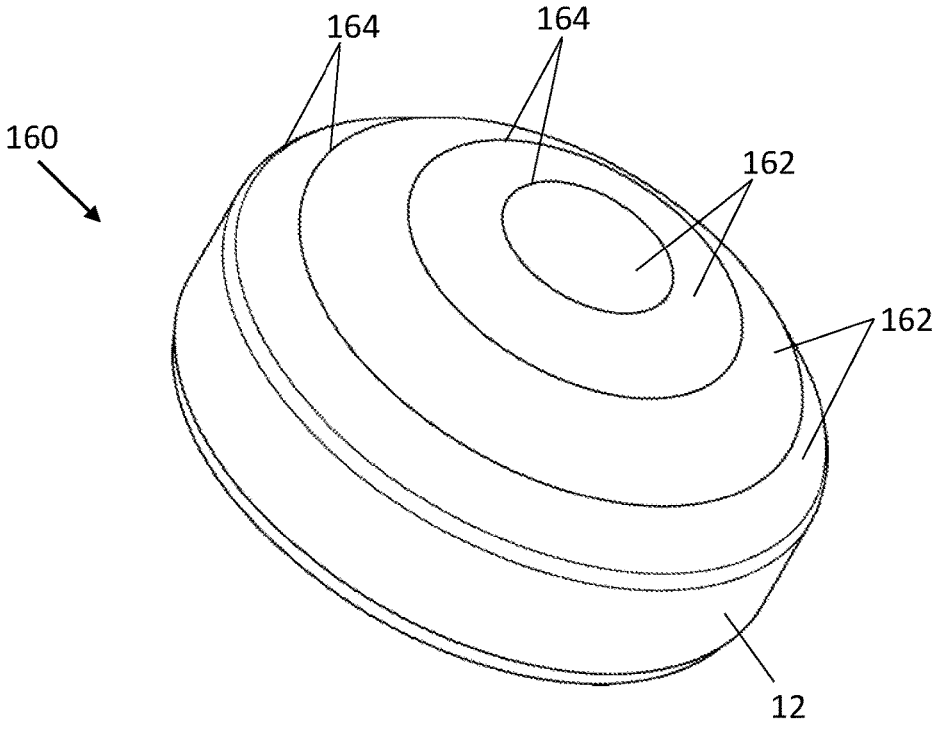
FIG. 22 is a top perspective view of a fifth alternate embodiment of the rupture disc.
Figure 23:
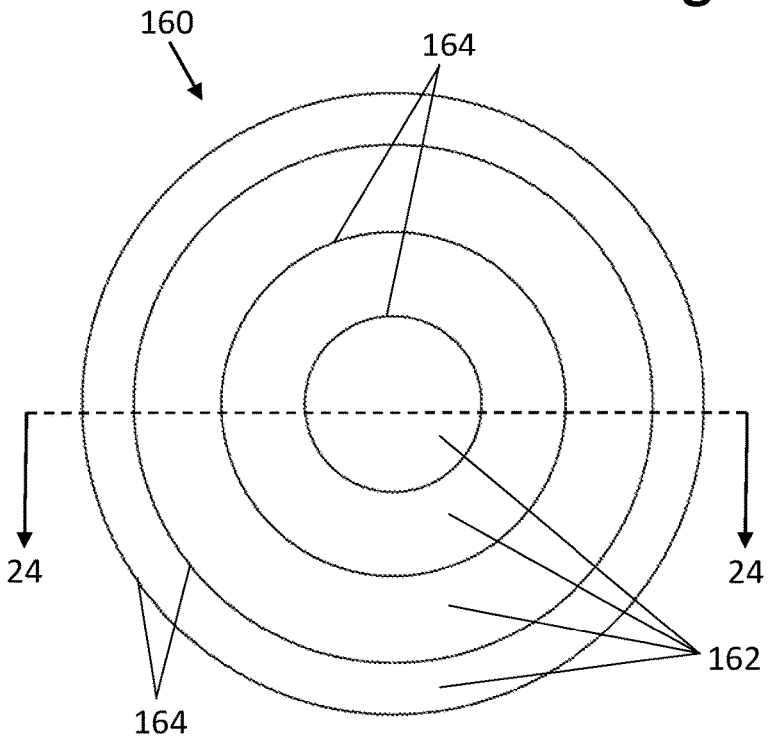
FIG. 23 is a top view of the rupture disc shown in FIG. 22.
Figure 24:
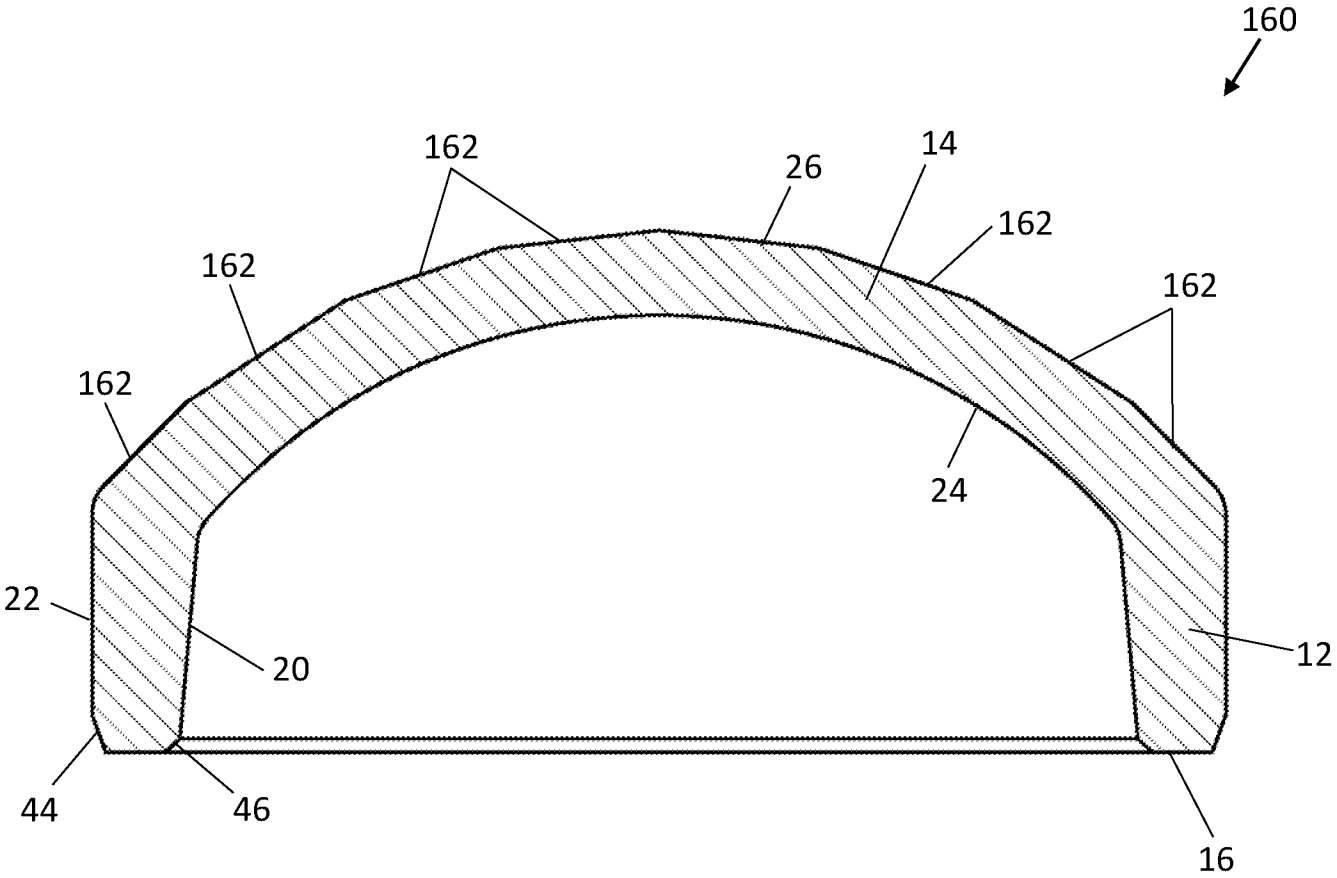
FIG. 24 is sectional view of the rupture disc shown in FIG. 22 taken along line 24-24.

FIGS. 22-24 illustrate yet another alternate embodiment of the rupture disc. Rupture disc 160 includes base 12 and central portion 14. Base 12 of rupture disc 150 may include outer surface 22 having tapered distal portion 44 and inner surface 20 having tapered distal portion 46. Outer surface 22 and/or inner surface 20 may be tapered relative to central axis 23. Central portion 14 of rupture disc 160 may include outer surface 26 having a plurality of facets 162 defined by a plurality of seams 164, along with inner surface 24 having a continuous surface as shown in FIG. 24. In this embodiment, the seams 164 form concentric circles around central axis 23, and at least one of the facets 162 is a conical surface. In certain embodiments, the facets 162 form compound conical surfaces.

Figure 25:
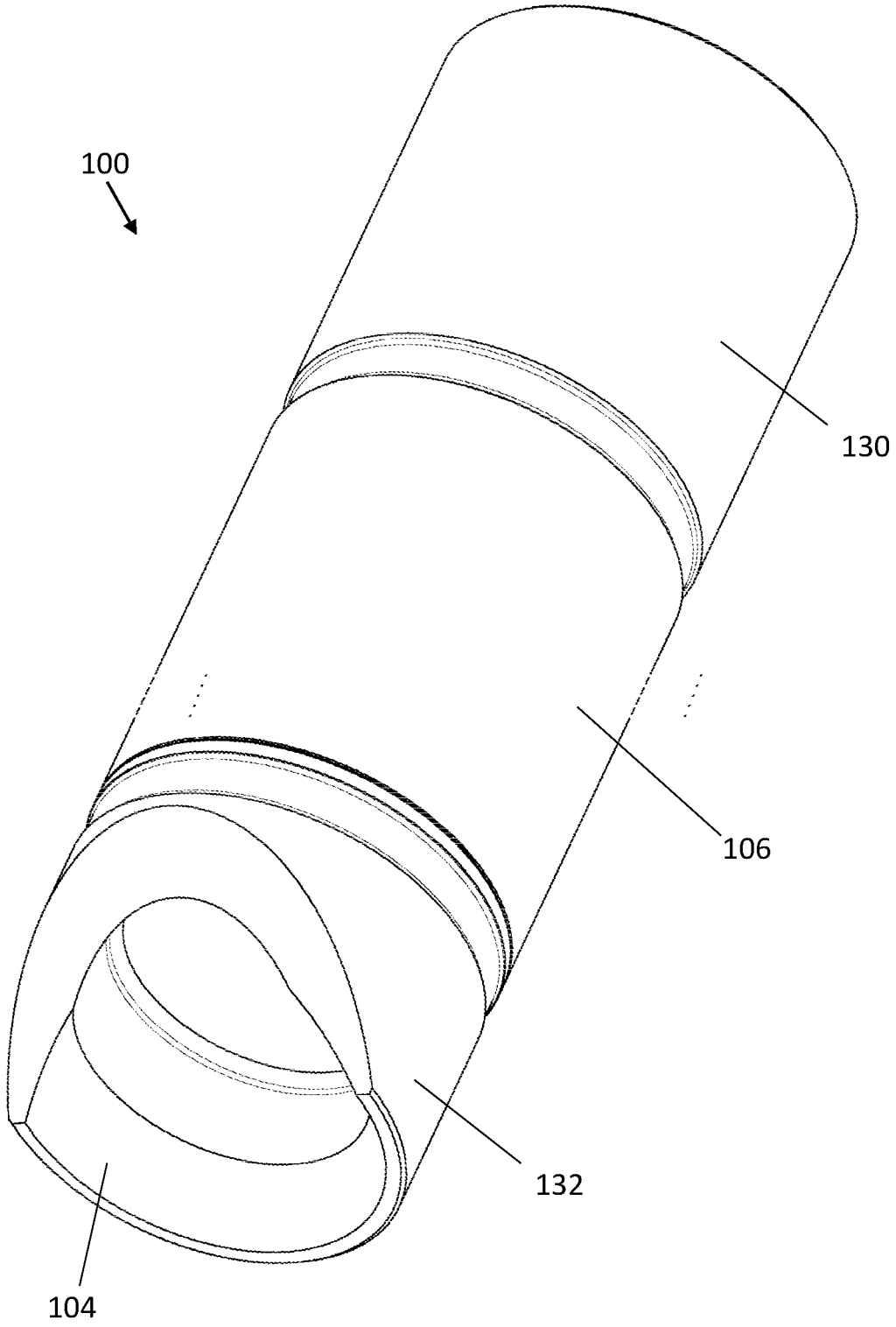
FIG. 25 is a perspective view of a rupture disc system including a rupture disc.
Figure 26:
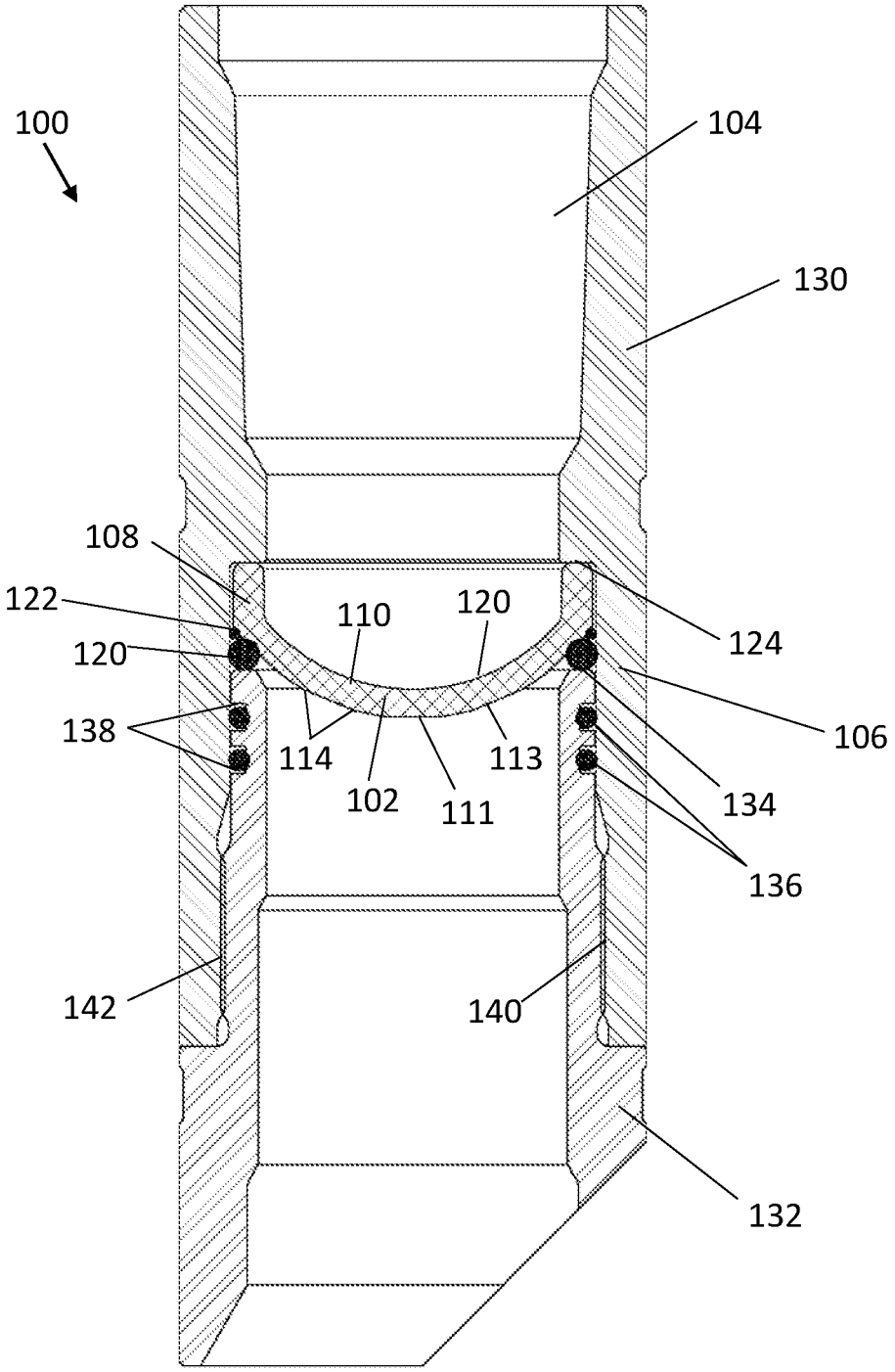
FIG. 26 is a sectional view of the rupture disc system.

With reference now to FIGS. 25 and 26, rupture disc system 100 may include rupture disc 102 disposed within housing central bore 104 of housing 106. Rupture disc 102 includes base 108 extending from a distal surface to a proximal end and central portion 110 extending across the proximal end of base 108. Rupture disc 102 includes a plurality of facets defined by a plurality of seams on outer surface 111 of central portion 110, on inner surface 112 of central portion 110, or on both outer surface 111 and inner surface 112 of central portion 110, as disclosed herein in connection with the various embodiments of the rupture disc. For example, rupture disc 102 in the embodiment illustrated in FIG. 26 includes a plurality of facets 113 defined by a plurality of seams 114 on outer surface 111 of central portion 110. The angular orientation of each facet 112 may vary from the angular orientation of adjacent facets 112. Rupture disc 102 may be configured to fracture along the plurality of seams 114 upon a rupture event.

Rupture disc 102 may be configured to fluidly seal housing central bore 104. Base 108 may extend along the axis of housing central bore 104, while central portion 110 may extend transversely across housing central bore 104. Rupture disc system 100 also includes sealing members, such as seal 120 and seal 122, configured to fluidly seal between the outer surface of base 108 of rupture disc 102 and an inner surface of housing central bore 104. Seals 120 and 122 may be formed of an elastomeric material, such as rubber, plastic, or a ductile sealing material. Seals 120 and 122 may be sized and configured to align with the inner surface of the housing central bore 104 (e.g., a generally circular shape) in a compressed stage. Housing 106 may include shoulder 124 extending transversely into housing central bore 104. The distal surface of base 108 of rupture disc 102 may engage shoulder 124 to secure rupture disc 102 within housing central bore 104.

In certain embodiments, housing 106 includes first housing member 130 connected to second housing member 132, such as with a threaded connection or any other secure connection method. Housing central bore 104 may be formed by a central bore in first housing member 130 and a central bore in second housing member 132. First housing member 130 may include shoulder 124. Distal end 134 of second housing member 132 may secure rupture disc 102 within housing central bore 104. In other words, base 108 of rupture disc 102 and seals 120, 122 may be secured between shoulder 124 of first housing member 130 and distal end 134 of second housing member 132. Secondary seal members 136 may be disposed within one or more grooves 138 in an outer surface of second housing member 132. Secondary seal members 136 may be configured to provide a fluid seal between the outer surface of second housing member 132 and the inner surface of first housing member 130. In this embodiment, rupture disc system 100 may be assembled by sliding rupture disc 102 and seals 120, 122 into the central bore of first housing member 130 until the distal surface of base 108 of rupture disc 102 engages shoulder 124. With secondary seal members 136 disposed in grooves 138, second housing member 132 may be connected to first housing member 130, such as with a threaded connection by engaging threaded portion 140 of first housing member 130 with threaded portion 142 of second housing member 132.

Rupture disc system 100 may be configured to provide a fluid seal with rupture disc 102 until a rupture event. In some embodiments, rupture disc 102 may be configured to fracture or break along plurality of seams 114 upon the rupture event, thereafter, allowing fluid flow through housing central bore 104. In other embodiments, rupture disc 102 may be configured to fracture or break at locations other than the plurality of seams 114. In one embodiment, the rupture event may be application of a pressure on outer surface 111 of central portion 110 of rupture disc 102 that meets or exceeds a first predefined pressure rating of outer surface 111. Alternately, the rupture event may be application of a pressure on inner surface 112 of central portion 110 of rupture disc 102 that meets or exceeds a second predefined pressure rating of inner surface 112. As described above, the first predefined pressure rating of outer surface 111 may be higher than the second predefined pressure of inner surface 112. Alternatively, the rupture event may be a hydraulic or mechanical breaking of central portion 110 of rupture disc 102. Upon the rupture event, rupture disc 102 breaks along the plurality of seams 114 to fracture rupture disc 102 into a greater number of fragments than conventional rupture discs. In other embodiments, the rupture event includes contacting rupture disc 102 with a fluid capable of dissolving or otherwise breaking apart rupture disc 102.

Figure 27:
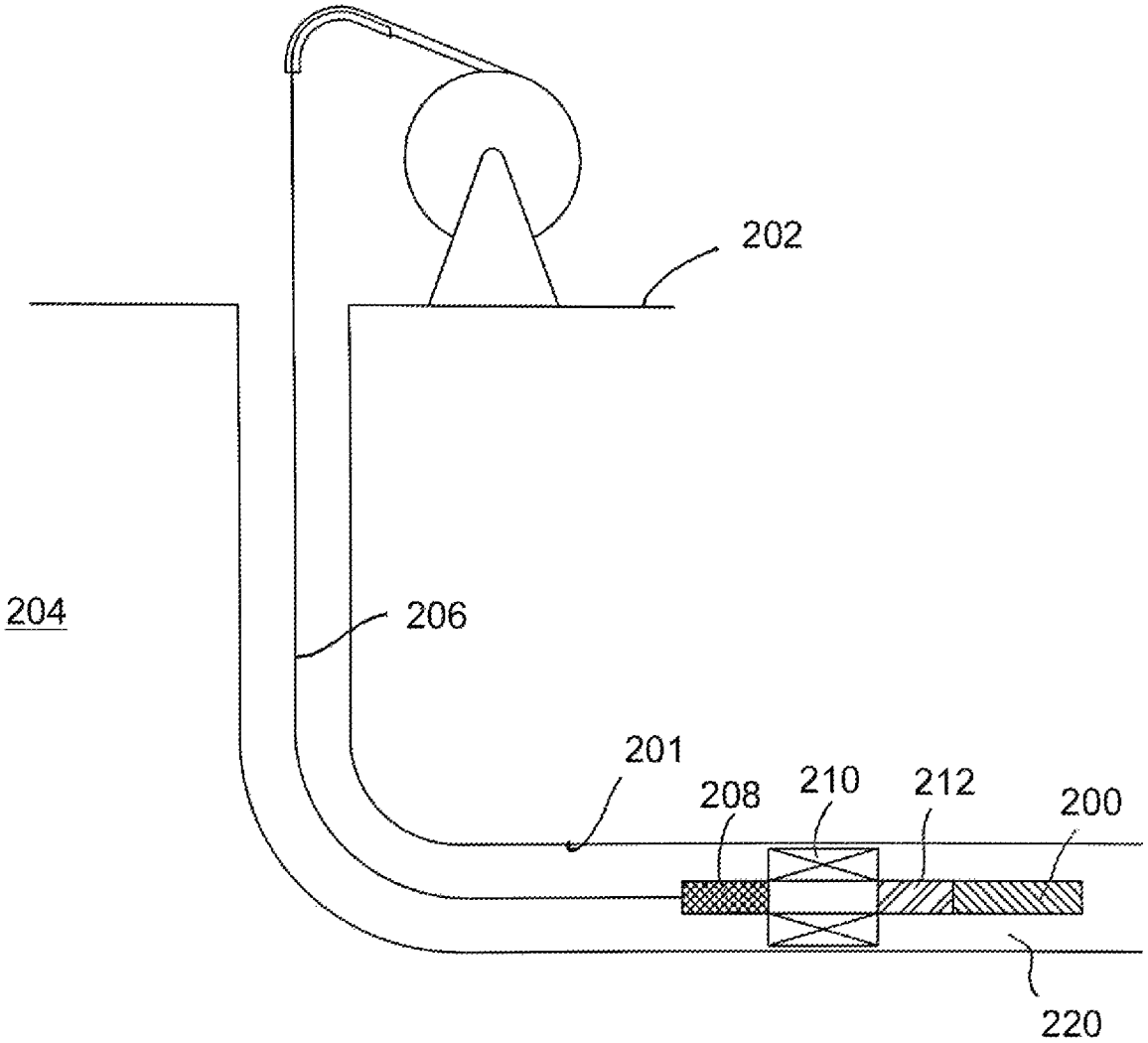
FIG. 27 is a plan view of the rupture disc system positioned in a wellbore using a coiled tubing string.

With reference to FIG. 27, rupture disc system 200 may be set in wellbore 201 extending below surface 202 through subterranean formation 204 using coiled tubing string 206. Rupture disc system 200 may be secured to a distal end of coiled tubing string 206, with coiled tubing connector 208, packer 210, and pup joint 212 secured between the distal end of coiled tubing string 206 and the proximal end of rupture disc system 200. Rupture disc system 200 and packer 210 may be set within wellbore 201 to fluidly seal distal portion 220 of wellbore 201 from surface 202. Rupture disc system 200 may include the same features and components as rupture disc system 100, including a rupture disc with the features and components of any of the rupture discs described and illustrated in FIGS. 1-24 and 26. In one embodiment, rupture disc system 200 is oriented such that the inner surface of the rupture disc is upstream of the outer surface of the central portion of the rupture disc within rupture disc system 200.

When a user desires to restore fluid communication between distal portion 220 of wellbore 201 and surface 202, the user may create a rupture event to fracture the rupture disc within rupture disc system 200, thereby allowing fluid flow through rupture disc system 200 and restoring fluid communication with distal portion 220 of wellbore 201. The rupture event may cause the central portion of the rupture disc to fracture or break along a plurality of seams.

In one embodiment, the rupture event may be created by pumping a fluid into wellbore 201 to apply a pressure that meets or exceeds a predefined pressure rating of an upstream surface of the central portion of the rupture disc within rupture disc system 200. In embodiments in which the rupture disc's inner surface is upstream of the outer surface of central portion 110, the rupture event may be created by pumping a fluid into wellbore 201 to apply a pressure that meets or exceeds a first predefined pressure rating of the outer surface of the rupture disc's central portion within rupture disc system 200. The first predefined pressure rating of the outer surface may be higher than a second predefined pressure rating of the rupture disc's inner surface due to the convex shape of the outer surface and the concave shape of the inner surface. This configuration enables rupture disc system 200 to withstand higher pressure "kicks" from downstream fluids, while being capable of fracturing or breaking in response to a lower pressure than the "kick" upstream of the rupture disc within rupture disc system 200. For example, without limiting the scope of this disclosure, the first predefined pressure rating of the rupture disc's outer surface may be about 10,000 psi and the second predefined pressure rating of the rupture disc's inner surface may be about 2,000 psi. In this example, the rupture disc's central portion may withstand (i.e., remain intact) a fluid pressure kick (e.g., 5,000 to 6,000 psi) from the downstream direction on its outer surface, but the central portion may be ruptured or fractured by application of a pressure exceeding about 2,000 psi (e.g., 2,500 psi) from the upstream direction on its inner surface.

Alternatively, the rupture event may be created by applying a mechanical or physical force on the rupture disc's central portion in rupture disc system 200. In another embodiment, the rupture disc within rupture disc system 200 is formed of a soluble material, and the rupture event may be created by introducing a fluid that dissolves or otherwise breaks down the soluble material of the rupture disc. Embodiments in which the rupture disc is formed of a soluble material may be used in underbalanced wells. In each embodiment in which the inner surface is upstream of the outer surface of the rupture disc's central portion, the rupture disc may be configured to withstand a fluid pressure kick from the downstream direction on the outer surface even when the pressure of the fluid pressure kick is greater than the second predefined pressure rating of the inner surface.

Figure 28:
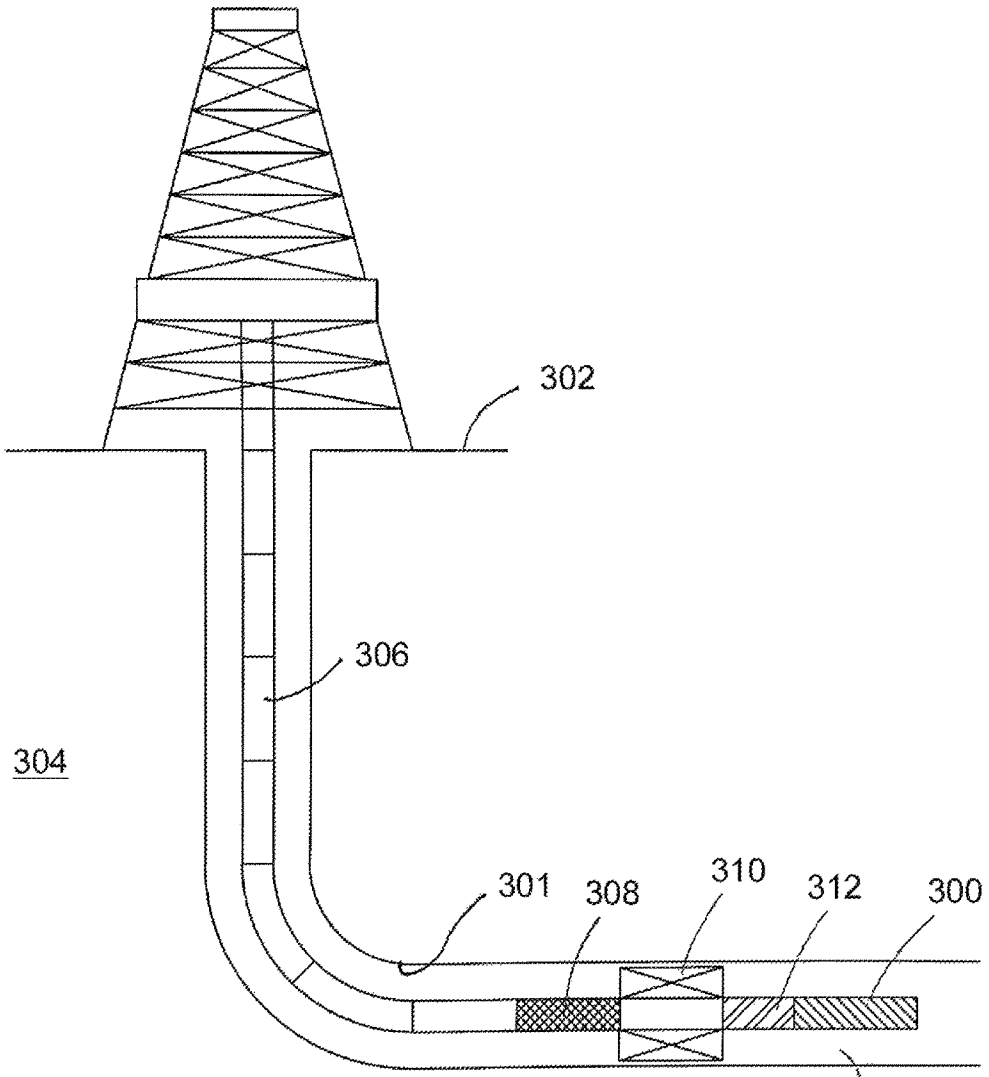
FIG. 28 is a plan view of the rupture disc system positioned in a wellbore using a tubular string.

Referring now to FIG. 28, rupture disc system 300 may be set in wellbore 301 extending below surface 302 through subterranean formation 304 using tubular drill pipe string 306. Rupture disc system 300 may be secured to a distal end of tubular string 306, with crossover 308, packer 310, and pup joint 312 secured between the distal end of tubular string 306 and the proximal end of rupture disc system 300. Rupture disc system 300 and packer 310 may be set within wellbore 301 to fluidly seal distal portion 320 of wellbore 301 from surface 302. Rupture disc system 300 may include the same features and components as rupture disc system 100, including a rupture disc with the features and components of any of the rupture discs described and illustrated in FIGS. 1-24 and 26. In one embodiment, rupture disc system 300 is oriented such that the inner surface of the rupture disc is upstream of the outer surface of the central portion of the rupture disc within rupture disc system 300.

When a user desires to restore fluid communication between distal portion 320 of wellbore 301 and surface 302, the user may create a rupture event to fracture the rupture disc within rupture disc system 300, thereby allowing fluid flow through rupture disc system 300 and restoring fluid communication with distal portion 320 of wellbore 301. The rupture event may cause the central portion of the rupture disc to fracture or break along a plurality of seams. The rupture event may be any of the events described above, including but not limited to, application of a pressure that exceeds a predefined pressure rating for the upstream side of the rupture disc within rupture disc system 300, application of a mechanical or physical force on the central portion of the rupture disc within rupture disc system 300, or introduction of a fluid that dissolves or otherwise breaks down a soluble material of the rupture disc within rupture disc system 300. Embodiments in which the rupture disc is formed of a soluble material may be used in underbalanced wells. In each embodiment in which the inner surface of the rupture disc's central portion is upstream of its outer surface, the rupture disc may be configured to withstand a fluid pressure kick from the downstream direction on the outer surface even when the pressure of the fluid pressure kick is greater than the second predefined pressure rating of the central portion's inner surface.

Except as otherwise described or illustrated, each of the components in this device may be formed of steel, another metal, or any other durable material. Portions of rupture disc systems 100, 200, and 300 may be formed of a wear resistant material, such as tungsten carbide or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A rupture disc configured to fluidly seal a passageway, comprising: a base extending from a distal surface to a proximal end, wherein the base defines a central axis; a central portion extending across the proximal end of the base, wherein the central portion traverses the central axis, wherein at least one surface of the central portion includes a plurality of facets defined by a plurality of seams, wherein at least one of the plurality of facets is a flat surface having an angular orientation that varies from the angular orientation of adjacent facets, and wherein the rupture disc is disposed within the passageway.

2. The rupture disc of claim 1, wherein one or more of the plurality of facets has a hexagonal shape or a pentagonal shape.

3. The rupture disc of claim 1, wherein the plurality of facets forms a web pattern.

4. The rupture disc of claim 1, wherein at least one of the plurality of facets is a conical surface.

5. The rupture disc of claim 4, wherein at least two of the plurality of facets include compound conical surfaces.

6. The rupture disc of claim 1, wherein an outer surface of the central portion includes a plurality of facets.

7. The rupture disc of claim 1, wherein an inner surface of the central portion includes a plurality of facets.

8. The rupture disc of claim 1, wherein an outer surface and an inner surface of the central portion each includes a plurality of facets.

9. The rupture disc of claim 1, wherein an outer surface of the base includes a plurality of facets.

10. The rupture disc of claim 1, wherein an inner surface or an outer surface of the base includes a tapered portion relative to the central axis.

11. The rupture disc of claim 1, wherein an inner surface or an outer surface of the base is tapered relative to the central axis.

12. The rupture disc of claim 1, wherein the rupture disc is formed of a frangible material, and wherein the rupture disc is configured to fracture in response to a first predefined pressure applied to an outer surface of the central portion and a second predefined pressure applied to an inner surface of the central portion.

13. The rupture disc of claim 12, wherein the central portion is configured to fracture along the plurality of seams.

14. The rupture disc of claim 1, wherein the rupture disc is formed of a soluble material.

15. A rupture disc system for fluidly sealing a portion of a wellbore, comprising:

a housing including a housing central bore;

a rupture disc disposed within the housing central bore, the rupture disc including a base extending from a distal surface to a proximal end and a central portion extending across the proximal end of the base, wherein the central portion traverses a central axis defined by the base and extends across the housing central bore, wherein at least one surface of the central portion includes a plurality of facets defined by a plurality of seams, and wherein at least one of the plurality of facets is a flat surface having an angular orientation that varies from the angular orientation of adjacent facets; and one or more sealing members engaging the rupture disc and an inner surface of the housing central bore to fluidly seal the housing central bore.

16. The rupture disc system of claim 15, wherein at least one of the plurality of facets is a conical surface.

17. The rupture disc system of claim 15, wherein the housing central bore includes a shoulder, and wherein the distal surface of the base of the rupture disc engages the shoulder of the housing central bore.

18. The rupture disc system of claim 17, wherein the housing includes a first housing member secured to a second housing member, wherein the first housing member and the second housing member each includes a central bore together forming the housing central bore, wherein the central bore of the first housing member includes the shoulder, and wherein the proximal end of the rupture disc engages a distal end of the second housing member.

19. The rupture disc system of claim 15, wherein the rupture disc is formed of a frangible material, and wherein the central portion of the rupture disc is configured to fracture along the plurality of seams in response to a first predefined pressure applied to an outer surface of the central portion or a second predefined pressure applied to an inner surface of the central portion.

20. The rupture disc system of claim 15, wherein the rupture disc is formed of a soluble material.

21. A method of selectively sealing a portion of a wellbore, comprising the steps of:

a) providing a rupture disc system comprising: a housing including a housing central bore; a rupture disc disposed within the housing central bore, wherein the rupture disc includes a base extending from a distal surface to a proximal end and a central portion extending across the proximal end of the base, wherein the central portion traverses a central axis defined by the base and extends across the housing central bore, wherein at least one surface of the central portion includes a plurality of facets defined by a plurality of seams, wherein at least one of the plurality of facets is a flat surface having an angular orientation that varies from the angular orientation of adjacent facets; and one or more sealing members engaging the rupture disc and an inner surface of the housing central bore to fluidly seal the housing central bore;

b) positioning the rupture disc system within a wellbore to fluidly seal a portion of the wellbore with the rupture disc disposed in the housing central bore; and c) generating a rupture event to fracture the rupture disc, thereby opening the housing central bore and allowing fluid flow to the portion of the wellbore.

22. The method of claim 21, wherein at least one of the plurality of facets is a conical surface.

23. The method of claim 21, wherein the rupture disc is formed of a frangible material, and wherein the rupture event in step (c) includes application of a first predefined pressure applied to an outer surface of the central portion or application of a second predefined pressure applied to an inner surface of the central portion.

24. The method of claim 21, wherein the rupture disc is formed of a soluble material, and wherein the rupture event in step (c) includes introduction of a fluid the dissolves or breaks down the soluble material.

* * * * *